US005521138A

United States Patent [19]

Shimada et al.

[11] Patent Number: 5,521,138

[45] Date of Patent: May 28, 1996

[54] REVERSIBLE THERMOSENSITIVE COLORING COMPOSITION, AND RECORDING MEDIUM USING THE SAME

[75] Inventors: Masaru Shimada, Shizuoka; Hiroshi Goto, Fuji; Eiichi Kawamura, Numazu; Shoji Maruyama; Keishi Kubo, both of Yokohama; Kyoji Tsutsui, Mishima, all of Japan

[73] Assignee: Ricoh Company, Ltd., Tokyo, Japan

[21] Appl. No.: 902,834

[22] Filed: Jun. 23, 1992

[30] Foreign Application Priority Data

Jun. 29, 1991 [JP] Japan ..... 3-185244
Jun. 29, 1991 [JP] Japan ..... 3-185245

[51] Int. Cl.[6] ..... B41M 5/26

[52] U.S. Cl. ..... 503/209; 106/21 A; 106/21 C; 106/21 R; 503/201; 503/208

[58] Field of Search ..... 503/201, 204, 503/208, 209; 106/21 R, 21 A, 21 C

[56] References Cited

U.S. PATENT DOCUMENTS 4,423,116 12/1993 Fox ..... 428/411
4,917,948 4/1990 Hotta .

FOREIGN PATENT DOCUMENTS 0492628 7/1992 European Pat. Off. .
2503729 10/1982 France .
2538309 6/1984 France .
2591534 6/1987 France .

*Primary Examiner*—Pamela R. Schwartz
*Attorney, Agent, or Firm*—Oblon, Spivak, McClelland, Maier & Neustadt

[57] ABSTRACT

A reversible thermosensitive coloring composition is composed of an electron-donor coloring compound; an electron-acceptor compound which is capable of producing a colored material with a regularly aggregated structure in the electron-doner coloring compound at a color development initiation temperature to obtain a color development state, and is capable of crystallizing out of the colored material at a decolorization initiation temperature which is lower than the color development initiation temperature; and an organic compound serving as a decolorization-accelerating agent capable of inducing the destruction of the regularly aggregated structure of the colored material to accelerate the decolorization of the composition. A reversible thermosensitive coloring recording medium is composed of a support and a recording layer formed thereon, which contains the above-mentioned reversible thermosensitive coloring composition.

6 Claims, 9 Drawing Sheets

REVERSIBLE THERMOSENSITIVE COLORING COMPOSITION, AND RECORDING MEDIUM USING THE SAME

BACKGROUND OF THE INVENTION

1. Field of the Invention

This invention relates to a reversible thermosensitive coloring composition capable of developing and decolorizing a colored image repeatedly by utilizing a coloring reaction between an electron-donor coloring compound and an electron-acceptor compound and, more particularly, to a reversible thermosensitive coloring composition capable of stably maintaining the color development state and the decolorization state thereof at room temperature. This invention also relates to a reversible thermosensitive recording medium using the above-mentioned reversible thermosensitive coloring composition.

2. Discussion of the Background

Conventionally, thermosensitive recording media utilizing a coloring reaction between electron-donor coloring compounds (hereinafter, referred to as coloring agents) and electron-acceptor compounds (hereinafter, referred to as color developers) are widely known and have been employed in various fields, for instance, for use with terminal printers for computers, facsimile apparatus, automatic ticket vending apparatus, printers for scientific measuring instruments, and printers for CRT medical measuring instruments. However, such conventional thermosensitive recording media for use with the above-mentioned products do not have reversibility with respect to the coloring or decolorizing in image formation, so that the color development and the decolorization cannot be alternately performed repeatedly.

Among published patents, there are several proposals for thermosensitive recording media which can reversibly develop and decolorize or erase colored images utilizing a coloring reaction between coloring agents and color developers. For example, a thermosensitive recording medium using the combination of phloroglucinol and gallic acid as color developers is disclosed in Japanese Laid-Open Patent Application 60-193691. The images obtained by developing a color using gallic acid and phloroglucinol upon the application of heat thereto, is erased when coming into contact with water or aqueous vapor. In the case where this type of thermosensitive recording medium is employed, there are difficulties in imparting water-resisting properties to the recording medium and obtaining stable recording preservability. Furthermore, there is another problem in that a large image erasing apparatus is required to erase the displayed image on the above-mentioned recording medium.

In Japanese Laid-Open Patent Application 61-237684, a rewritable optical information recording medium which employs compounds such as phenolphthalein, thymolphthalein and bisphenol as color developers is disclosed. In the above optical information recording medium, colored images are formed by applying heat thereto and gradually decreasing the temperature thereof. The colored images can be decolorized or erased by applying heat to the recording medium at a temperature higher than the image developing temperature, and then rapidly cooling the recording medium. In the case of this optical information recording medium, the color developing and decolorizing steps are complicated and the contrast of the colored image is not satisfactory with some color remaining on the erased image which is obtained by erasing the displayed image.

In Japanese Laid-Open Patent Applications 62-140881, 62-138568, and 62-138556, thermosensitive recording media using a homogeneously dissolved composition of a coloring agent, a color developer and a carboxylic acid ester are disclosed. The above recording media can assume a completely colored state at a low temperature, a completely decolorized state at a high temperature, and can maintain the colored state or the decolorized state at a temperature midway between the above-mentioned low temperature and high temperature. When heat is applied to the recording media using a thermal head, a white image (decolorized image), which is similar to a photographic negative, is recorded on the colored background. Accordingly, the usage of above recording media is limited. It is also necessary that the temperature of the recording media be maintained within a specific range in order to preserve the recorded image on the recording media.

In Japanese Laid-Open Patent Applications 2-1882914 and 2-188293, there are disclosed a thermosensitive recording medium utilizing a salt of gallic acid and a higher aliphatic amine, and a thermosensitive recording medium utilizing a salt of a bis(hydroxyphenyl)acetic acid or butyric acid and a higher aliphatic amine. These salts have a reversible color developing and decolorizing function. With this type of recording medium, a colored image can be developed in a specific temperature range with the application of heat thereto, and can be decolorized or erased by applying heat thereto at a higher temperature than the above-mentioned specific temperature range. However, since the color developing effect and the decolorizing effect competitively occur, it is difficult to thermally control these effects by changing the temperature of the recording medium. Therefore, it is difficult to obtain a stable image contrast.

As mentioned above, the conventional reversible thermosensitive recording media utilizing the coloring reaction between a coloring agent and a color developer have many problems and are unsatisfactory for use in practice. In particular, a multiple colored image on a conventional reversible thermosensitive recording medium is completely unsatisfactory.

The inventors of the present invention have studied the coloring reactions between a variety of coloring agents and color developers. As a result, it is found that a coloring composition which comprises as a color developer a compound with a specific structure can perform stable color development and decolorization repeatedly as disclosed in Japanese Laid-Open Patent Application 03-355078.

The above-mentioned coloring composition contains a coloring agent and a color developer with a long-chain aliphatic group in its molecule. This coloring composition assumes a color development state by temporarily heating to a color development initiation temperature at which the coloring agent and the color developer are fused to develop a colored image. The colored image on the coloring composition is decolorized when temporarily heated to a temperature lower than the color development initiation temperature. This coloring composition can perform remarkably stable color development and decolorization in comparison with the above-mentioned conventional reversible thermosensitive coloring compositions, and therefore, a recording material which employs this coloring composition is capable of forming and erasing images easily by use of a generally used heat source such as a thermal head or heat roller. However, there are problems still remaining to be solved with respect to the image density after decolorization, the decolorization temperature range wherein the coloring composition assumes a decolorized state, and the decolorization speed, to obtain a coloring composition capable of yielding high quality images for practical use and to prepare a convenient reversible thermosensitive recording medium using such a coloring composition.

SUMMARY OF THE INVENTION

It is therefore a first object of the present invention to provide a reversible thermosensitive coloring composition free from the above-mentioned conventional defects, which is capable of performing the color development and the decolorization with the application of heat thereto, utilizing the reaction between a coloring agent and a color developer. More specifically, an object of this invention is to provide a reversible thermosensitive coloring composition which can speedily perform uniform decolorization without some color remaining on the erased image and which has a wide temperature range wherein the coloring composition can assume a decolorized state, and the decolorization initiation temperature of which composition can be freely determined.

A second object of the present invention is to provide a reversible thermosensitive coloring recording medium which can perform the color development and the erasure repeatedly, with stable formation of colored images and complete decolorization thereof, using the above-mentioned reversible thermosensitive coloring composition.

The first object of the present invention can be achieved by a reversible thermosensitive coloring composition comprising an electron-donor coloring compound; an electron-acceptor compound (a) capable of producing a reversible thermosensitive coloring composition comprising an electron-donor coloring compound, an electron-acceptor compound (a) capable of producing a colored material with a regularly aggregated structure in the electron-donor coloring compound with the application of heat thereto to a color development initiation temperature which is above the melting point of the mixture of the electron-donor coloring compound and the electron-acceptor compound to obtain a color development state, and (b) capable of crystallizing out of the colored material when the regularly aggregated structure of the colored material is destroyed with the application of heat thereto to a decolorization initiation temperature which is below the color development initiation temperature to obtain a decolorization state, thereby reversibly providing the color development state and the decolorization state, and an organic compound serving as a decolorization-accelerating agent dispersed in the coloring composition in the form of molecules or minute domains, capable of inducing the destruction of the regularly aggregated structure of the colored material and accelerating the decolorization of the colored material in a decolorization process to obtain the The second object of the present invention can be achieved by a reversible thermosensitive coloring recording medium comprising a support and a reversible thermosensitive recording layer formed thereon which comprises the above-mentioned reversible thermosensitive coloring composition.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The reversible thermosensitive coloring composition according to the present invention comprises a coloring agent, a color developer and an organic compound serving as a decolorization-accelerating agent. The decolorization-accelerating agent for use in the present invention has several functions, which are determined by the relative relationship between the temperature characteristics of a mixture of the color developer and the coloring agent and those of the decolorization-accelerating agent.

The color development and the decolorization phenomena of the reversible thermosensitive coloring composition of the present invention will now be explained with reference to FIG. 1.

Figure 1:
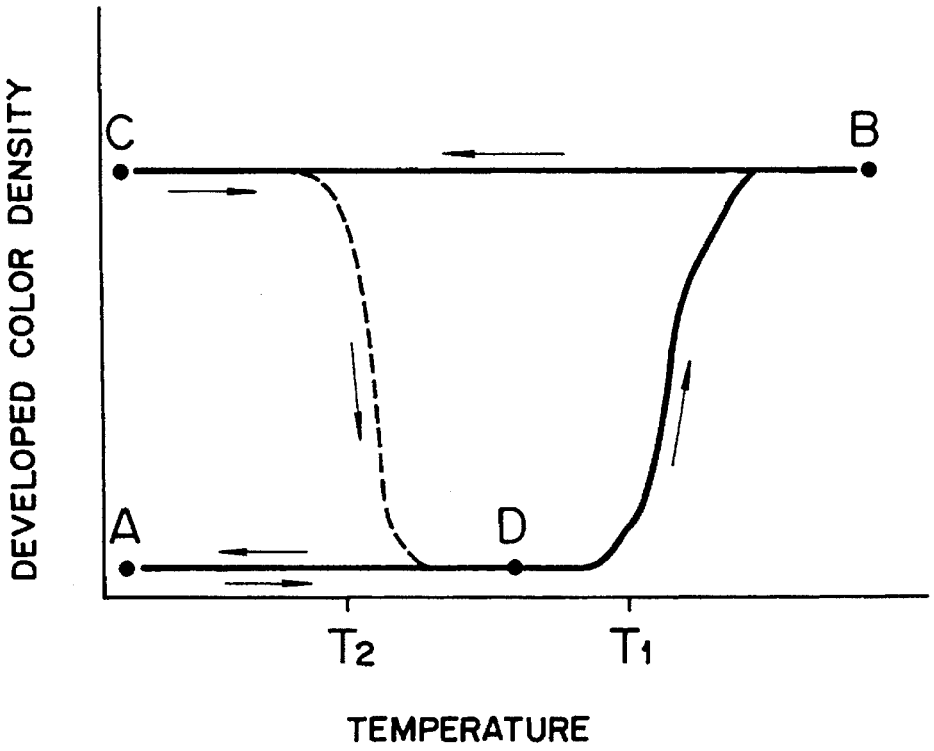
FIG. 1 is a graph showing the relationship between the temperature of a coloring composition of the present invention and the density thereof for explanation of the color development and decolorization process of a reversible thermosensitive coloring composition of the present invention.

As shown in FIG. 1, the color density of the reversible thermosensitive coloring composition according to the present invention changes depending on the temperature thereof. The x axis of the graph indicates the temperature of the reversible thermosensitive coloring composition of the present invention, and the y axis of the graph indicates the density on the reversible thermosensitive coloring composition.

In FIG. 1, reference symbol A shows the decolorization state of the composition at room temperature, reference symbol B shows the color development state of the composition when the composition is fused by the application of heat thereto, and reference symbol C shows the color development state of the composition at room temperature.

The reversible thermosensitive coloring composition of the present invention is supposed to assume the above-mentioned decolorization state A. When the temperature of the composition in this state is raised and reaches temperature $T_1$, the color density of the composition begins to increase since the coloring agent and the color developer begin to fuse in combination at the temperature $T_1$. As the temperature of the composition is further increased, the developed color density of the composition increases and finally the composition assumes the color development state B. While the temperature of the composition in the state B is decreased to room temperature, the color development state is maintained and the composition assumes the state C. The process from decolorization to color development as explained above is indicated by the solid line in the direction of the arrow in FIG. 1.

When the temperature of the coloring composition in the state C is raised again, the density is initiated to decrease at temperature $T_2$ and the coloring composition finally reaches the state D, that is a completely decolorized state. When the temperature of the coloring composition in the state D is decreased, the decolorization state of the coloring composition is maintained, and the composition returns to the initial state A. The process from color development to decolorization as explained above is indicated by the broken line in FIG. 1. Thus, in FIG. 1, the temperature $T_1$ is the color development initiation temperature at which the color development begins, and the temperature $T_2$ is the decolorization initiation temperature at which the decolorization begins. The temperature range from $T_2$ to $T_1$ is a decolorization temperature range where the coloring composition assumes a decolorization state.

The color developing and decolorizing phenomenon of the reversible thermosensitive coloring composition according to the present invention shown in FIG. 1 is characterized in that the above-mentioned decolorization temperature range is located in a zone lower than the color development initiation temperature at which the coloring composition is initiated to fuse and carry out a coloring reaction. Therefore, the coloring composition in the color development state at room temperature can be decolorized when heated to a temperature within the decolorization temperature range. In addition, such color development and decolorization phenomena can be repeatedly caused on the coloring composition.

FIG. 1 shows one example of the process of color development and decolorization of the reversible thermosensitive coloring composition according to the present invention. The color development initiation temperature and the decolorization initiation temperature vary, depending upon the combination of coloring agent and color developer to be employed. The color density in the state B is not always the same as that in the state C. These color densities may be different.

The reversibility of the coloring composition according to the present invention is basically achieved by the combination of the color developer and the coloring agent. The color developer for use in the present invention has not only a structure capable of inducing color formation in the coloring agent, but also a long-chain aliphatic group (hereinafter referred to as long-chain structure) in its molecule. The combination of the color developer and the coloring agent is appropriately determined after confirming that a sample in the color development state which is obtained by fusing a mixture of a color developer and a coloring agent under application of heat thereto and thereafter cooling it rapidly exhibits exothermic phenomenon with the increase of temperature in the differential thermal analysis (DTA) or differential scanning calorimetric analysis (DSC).

As described above, the reversible thermosensitive coloring composition of the present invention can assume a color development state by temporary application of heat thereto to a color development initiation temperature which is above the melting point of the mixture of the color developer and the coloring agent, followed by promptly cooling. In the color development state, the condition of the above reversible thermosensitive coloring composition according to the present invention is different from that of the conventional thermosensitive coloring composition without reversibility. In the conventional coloring composition without reversibility, the colored material obtained by the coloring reaction between the color developer and the coloring agent is in an amorphous condition. In contrast to this, a regularly aggregated structure is constructed in the colored material in the reversible thermosensitive coloring composition of the present invention.

Moreover, in a conventional coloring composition which has reversibility, but cannot maintain a stable color development state at room temperature because of a weak bond between the coloring agent and the color developer, the colored material is also in an amorphous condition.

It is thought that the regularly aggregated structure is constructed in the colored material due to the cohesive force in the previously mentioned long-chain structure of the color developer in the color development state of the reversible thermosensitive coloring composition according to the present invention. Such structure can be stably maintained at room temperature, so that the coloring composition can continue to assume the color development state-at room temperature.

As previously mentioned, the reversible thermosensitive coloring composition begins to assume the color development state at a color development initiation temperature in such a fashion that the regularly aggregated structure is constructed in the colored material. When the coloring composition in the color development state is heated once again, the decolorization smoothly occurs at a decolorization initiation temperature lower than the color development initiation temperature. The decolorization results when the regularly aggregated structure of the colored material is destroyed by a temperature rise. Once the regularly aggregated structure of the colored material is destroyed, the color developer, which has a strong cohesive force therein due to its long-chain structure, crystallizes out of the colored material. The coloring composition consequently assumes a decolorization state.

Understandably, therefore, the color developer with a long-chain structure contained in the coloring composition of the present invention contributes to the maintenance of the color development state in such a way that the regularly aggregated structure is formed in the colored material, and to the decolorization in such a way that the regularly aggregated structure of the colored material is destroyed.

In the present invention, the reversible thermosensitive coloring composition comprises a decolorization-accelerating agent. The decolorization-accelerating agent for use in the present invention has three main functions.

The first function of the decolorization-accelerating agent is to change the regularly aggregated structure of the colored material formed in the color development state, and to accelerate the decolorization of the coloring composition.

The decolorization of the coloring composition takes place when the regularly aggregated structure of the colored material which is once formed in the color development state is destroyed, as previously mentioned. It is determined by the cohesive forces in the colored material and the regularity of the aggregated structure thereof whether the regularly aggregated structure of the colored material is easily destroyed or not. For example, when the cohesive forces are weakened and the regularity of the aggregated structure is lowered, the aggregated structure of the colored material is destroyed at a lower temperature, and the decolorization initiation temperature shifts in the lower temperature direction.

The regularity of the aggregated structure of the colored material can be controlled, for example, by the cooling speed of the coloring composition in the step of causing the color development.

When the stable color development state with excellent reproducibility is taken into consideration, however, the addition of an organic compound serving as a decolorization-accelerating agent is regarded as effective in changing the regularly aggregated structure of the colored material.

The decolorization-accelerating agent for use in the present invention can be dispersed in the aggregated structure of the colored material in the form of minute domains or molecules, so that the cohesive forces to form the aggregated structure of the colored material and the regularity of the aggregated structure can be changed by the decolorization-accelerating agent. As a result, the regularly aggregated structure of the colored material is smoothly and uniformly destroyed, so that the decolorization of the coloring composition can be accelerated.

The reversible thermosensitive coloring composition according to the present invention comprises as a decolorization-accelerating agent an organic compound which is dispersed in the aggregated structure of the colored material in the form of minute domains or molecules in the color development state and is capable of lowering the regularity of the aggregated structure of the colored material to readily induce the destruction of aggregated structure in the decolorization process.

The aggregated structure of the colored material can be destroyed to induce the decolorization of the coloring composition by allowing the decolorization-accelerating agent to first melt. This is the second function of the decolorization-accelerating agent for use in the present invention.

When the reversible thermosensitive coloring composition comprises the decolorization-accelerating agent, the colored material which is obtained by heating the coloring composition to a color development initiation temperature followed by promptly cooling also has a regularly aggregated structure. The decolorization-accelerating agent is dispersed in the aggregated structure of the colored material, with forming minute domains therein.

In the case where the melting point of the decolorization-accelerating agent for use in the present invention is lower than a temperature where of the coloring composition not including the decolorization-accelerating agent is supposed to cause the decolorization, the decolorization-accelerating agent first fuses when the coloring composition in the color development state is heated. The fusion of the decolorization-accelerating agent induces the destruction of the regularly aggregated structure of the colored material. Thereafter, the color developer crystallizes out of the colored material, so that the coloring composition according to the present invention is decolorized.

The reversible thermosensitive coloring composition according to the present invention comprises as a decolorization-accelerating agent an organic compound which is dispersed in the aggregated structure of the colored material in the form of minute domains in the color development state and is capable of first melting in the colored material in the decolorization process so as to induce the destruction of the aggregated structure of colored material.

From the above explained mechanism, the decolorization initiation temperature of the coloring composition can be controlled by the melting point of the decolorization-accelerating agent added thereto. The melting point of the decolorization-accelerating agent is the one obtained in the dispersed condition in the coloring composition. In this case, the decolorization can be uniformly and speedily performed and the decolorized density of the coloring composition is satisfactorily lowered because no colored portion remains in the coloring composition, in comparison with the coloring composition without the decolorization-accelerating agent. This is because the decolorization-accelerating agent is uniformly dispersed in the colored material, forming minute domains.

It is supposed that molecules of the fused decolorization-accelerating agent activate the motion of the long-chain structure portion of the color developer which forms the aggregated structure of the colored material. Therefore, the aggregated structure of the colored material tends to be easily destroyed, so that the color developer acceleratingly crystallizes out of the colored material.

The third function of the decolorization-accelerating agent will now be explained. When the aggregated structure of the colored material is destroyed and the color developer crystallizes out of the colored material at a decolorization initiation temperature, the decolorization-accelerating agent for use in the present invention promotes the decolorization of the coloring composition, serving as nuclei for crystallization of the color developer. In this case, the decolorization-accelerating agent is also dispersed in the colored material with the regularly aggregated structure in the form of minute domains. In the case where the melting point of the decolorization-accelerating agent obtained when dispersed in the coloring composition is higher than the decolorization initiation temperature of the coloring composition without the decolorization-accelerating agent, the decolorization-accelerating agent becomes nuclei for crystallization and promotes the separation and crystallization of the color developer in the decolorization process. The separation and crystallization of the color developer smoothly progresses, and then the decolorization is speedily performed by the addition of this kind of decolorization-accelerating agent. Further, since the decolorization-accelerating agent is uniformly dispersed in the colored material in the form of minute domains, the color developer separates out and crystallizes uniformly with high density, so that the decolorized density is satisfactorily lowered by the addition of the decolorization-accelerating agent.

The reversible thermosensitive coloring composition according to the present invention comprises as a decolorization-accelerating agent an organic compound which is dispersed in the aggregated structure of the colored material in the form of minute domains in the color development state and is capable of serving as nuclei for crystallization when the regularly aggregated structure of the colored material is destroyed and the color developer crystallizes separately from the colored material in the decolorization process.

The decolorization of the coloring composition according to the present invention is accelerated because the decolorization-accelerating agent carries out one or more functions stated above. In particular, most of the decolorization-accelerating agent for use in the present invention can carry out the first function in the coloring composition. Therefore, when the decolorization-accelerating agent which can carry out the second function is selected and added to the coloring composition, decolorization of the coloring composition is accelerated owing to the combination of the first function and the second function. When the decolorization-accelerating agent potentially having the third function is added to the coloring composition, the combination of the first function and the third function promotes the decolorization of the coloring composition.

In the present invention, decolorization of the coloring composition can be accelerated due to the decolorization-accelerating agent. To accelerate the decolorization is specifically to lower the decolorization initiation temperature, to decrease the decolorized density, to carry out the uniform decolorization, and to increase decolorization speed, which are all important for the reversible thermosensitive coloring composition according to the present invention. For example, a decrease of the decolorization initiation temperature of a coloring composition makes it possible to expand the decolorization temperature range expressed by a difference between the color development initiation temperature and the decolorization initiation temperature. When such a coloring composition is used in a reversible thermosensitive coloring recording medium, the allowable temperature range set in a device for decolorizing the coloring composition can be made wide. Moreover, the decrease in the decolorized density and the improvement of uniform decolorization are directly linked with the improvement in image quality obtained the reversible thermosensitive coloring recording medium. Furthermore, it is essential to increase the decolorization speed to speedily perform the image formation and erasure process. Thus, the decolorization properties of the reversible thermosensitive coloring composition according to the present invention are improved by the above-mentioned advantages of the decolorization-accelerating agent.

It is preferable that the decolorization-accelerating agent for use in the present invention be uniformly dispersed in the regularly aggregated structure of colored material in the form of minute domains. Such a dispersed condition of the decolorization-accelerating agent can be easily obtained when the coloring composition of the present invention is fused, followed by promptly cooling. Therefore, it is preferable to employ the decolorization-accelerating agent having a melting point lower than a temperature where the coloring agent and the color developer in the coloring composition are fused to carry out a coloring reaction.

The decolorization-accelerating agent carries out the above-mentioned functions not only in the coloring composition which comprises a color developer with a long-chain structure and can maintain the color development state by keeping the regularly aggregated structure of the colored material, but also in the coloring composition in which the color developer easily crystallizes out of the colored material because of the weak cohesive force between the color developer and the coloring agent. In the latter case, it is considered that the decolorization-accelerating agent is fused with the application of heat to the coloring composition in the decolorization process to activate the molecular motion in the color composition, or functions as nuclei for crystallization of the color developer. The decolorization-accelerating agent for use in the present invention can be applied to a variety of reversible thermosensitive coloring compositions comprising the color developer and the coloring agent.

The color developer employed in the reversible thermosensitive coloring composition according to the present invention has not only a molecular structure having a capability of inducing color formation in the coloring agent, but also a long-chain moiety in the molecule which controls the cohesion between the molecules thereof.

Representative examples of preferable color developers for use in the present invention include an organic phosphoric acid compound, an aliphatic carboxylic acid, and a phenolic compound, each having a straight chain or branched chain alkyl group or alkenyl group having 12 or more carbon atoms.

More specifically, the organic phosphoric acid compounds represented by the following general formula (I) can be preferably employed in the present invention:

$$R^1—PO(OH)_2 \quad (I)$$

wherein $R^1$ represents a straight chain or branched chain alkyl group or alkenyl group having 12 or more carbon atoms.

Specific examples of the organic phosphoric acid compounds represented by general formula (I) are as follows: dodecylphosphonic acid, tetradecylphosphonic acid, hexadecylphosphonic acid, octadecylphosphonic acid, eicosylphosphonic acid, docosylphosphonic acid, tetracosylphosphonic acid, hexacosylphosphonic acid, and octacosylphosphonic acid.

As the aliphatic carboxylic acid compound for use in the color developer, α-hydroxycarboxylic acids represented by the following general formula (II) can be employed:

$$R^2—CH(OH)—COOH \quad (II)$$

wherein $R^2$ represents a straight chain or branched chain alkyl group or alkenyl group having 12 or more carbon atoms.

Specific examples of the α-hydroxycarboxylic acids represented by general formula (II) are as follows: α-hydroxydecanoic acid, α-hydroxytetradecanoic acid, α-hydroxyhexadecanoic acid, α-hydroxyoctadecanoic acid, α-hydroxypentadecanoic acid, α-hydroxyeicosanoic acid, α-hydroxydocosanoic acid, α-hydroxytetracosanoic acid, α-hydroxyhexacosanoic acid and α-hydroxyoctacosanoic acid.

Furthermore, as the aliphatic carboxylic acid compounds for use in the color developer, halogen-substituted compounds having a straight chain or branched chain alkyl group or alkenyl group having 12 or more carbon atoms, with the halogen bonded to at least one carbon atom at α-position or β-position of the compound can be employed.

Specific examples of such halogen-substituted compounds are as follows: 2-bromohexadecanoic acid, 2-bromoheptadecanoic acid, 2-bromooctadecanoic acid, 2-bromoeicosanoic acid, 2-bromodocosanoic acid, 2-bromotetracosanoic acid, 3-bromooctadecanoic acid, 3-bromoeicosanoic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanoic acid, 2-fluorodocosanoic acid, 2-iodohexadecanoic acid, 2-iodooctadecanoic acid, 3-iodohexadecanoic acid, 3-iodooctadecanoic acid, and perfluorooctadecanoic acid.

As the aliphatic carboxylic acid compound for use in the color developer, compounds having a straight chain or branched chain alkyl group or alkenyl group having 12 or more carbon atoms, including an oxo group with at least one carbon atom at the α-position, β-position or γ-position of the aliphatic carboxylic acid compound constituting the oxo group can be employed.

Specific examples of such compounds are as follows: 2-oxododecanoic acid, 2-oxotetradecanoic acid, 2-oxohexadecanoic acid, 2-oxooctadecanoic acid, 2-oxoeicosanoic acid, 2-oxotetracosanoic acid, 3-oxododecanoic acid, 3-oxotetradecanoic acid, 3-oxohexadecanoic acid, 3-oxooctadecanoic acid, 3-oxoeicosanoic acid, 3-oxotetracosanoic acid, 4-oxohexadecanoic acid, 4-oxooctadecanoic acid, and 4-oxodocosanoic acid.

As the aliphatic carboxylic acid compound for use in the color developer, dibasic acid compounds represented by the following general formula (III) can be employed:

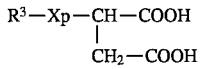

(III)

wherein $R^3$ represents a straight chain or branched chain alkyl group or alkenyl group having 12 or more carbon atoms, X represents an oxygen or sulfur atom and p represents 1 or 2.

Specific examples of the dibasic acids represented by general formula (III) are as follows: dodecylmalic acid, tetradecylmalic acid, hexadecylmalic acid, octadecylmalic acid, eicosylmalic acid, docosylmalic acid, tetracosylmalic acid, dodecylthiomalic acid, tetradecylthiomalic acid, hexadecylthiomalic acid, octadecylthiomalic acid, eicosylthiomalic acid, docosylthiomalic acid, tetracosylthiomalic acid, dodecyldithiomalic acid, tetradecyldithiomalic acid, hexadecyldithiomalic acid, octadecyldithiomalic acid, eicosyldithiomalic acid, docosyldithiomalic acid, and tetracosyldithiomalic acid.

As the aliphatic carboxylic acid compound for use in the color developer, dibasic acid compounds represented by the following general formula (IV) can be employed:

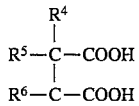

(IV)

wherein $R^4$, $R^5$ and $R^6$ each represent hydrogen an alkyl group or an alkenyl group, at least one of $R^4$, $R^5$ and $R^6$ being a straight chain or branched chain alkyl group or alkenyl group having 12 or more carbon atoms.

Specific examples of the dibasic acid compounds represented by general formula (IV) are as follows: dodecylbutane diacid, tridecylbutane diacid, tetradecylbutane diacid, pentadecylbutane diacid, octadecylbutane diacid, eicosylbutane diacid, docosylbutane diacid, 2,3-dihexadecylbutane diacid, 2,3-dioctadecylbutane diacid, 2-methyl-3-dodecylbutane diacid, 2-methyl-3-tetradecylbutane diacid, 2-methyl-3-hexadecylbutane diacid, 2-ethyl-3-dodecylbutane diacid, 2-propyl-3-decylbutane diacid, 2-octyl-3-hexadecylbutane acid, and 2-tetradecyl-3-octadecyl diacid.

As the aliphatic carboxylic acid compound for use in the color developer, dibasic acid compounds represented by the following general formula (V) can be employed:

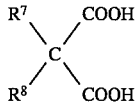

(V)

wherein $R^7$ and $R^8$ each represent hydrogen, an alkyl group or an alkenyl group, at least one of $R^7$ or $R^8$ being a straight chain or branched chain alkyl group or alkenyl group having 12 or more carbon atoms.

Specific examples of the dibasic acid compounds represented by general formula (V) are as follows: dodecylmalonic acid, tetradecylmalonic acid, hexadecylmalonic acid, octadecylmalonic acid, eicosylmalonic acid, docosylmalonic acid, tetracosylmalonic acid, didodecylmalonic acid, ditetradecylmalonic acid, dihexadecylmalonic acid, dioctadecylmalonic acid, dieicosylmalonic acid, didocosylmalonic acid, methyloctadecylmalonic acid, methyleicosylmalonic acid, methyldocosylmatonic acid, methyltetracosylmalonic acid, ethyloctadecylmalonic acid, ethyleicosylmalonic acid, ethyldocosylmalonic acid, and ethyltetracosylmalonic acid.

As the aliphatic carboxylic acid compound for use in the color developer, dibasic acid compounds represented by the following general formula (VI) can be employed:

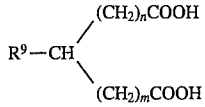

(VI)

wherein $R^9$ represents a straight chain or branched chain alkyl group or alkenyl group having 12 or more carbon atoms; and n is an integer of 0 or 1, m is an integer of 1, 2 or 3, and when n is 0, m is 2 or 3, while when n is 1, m is 1 or 2.

Specific examples of the dibasic acid compound represented by general formula (VI) are as follows: 2-dodecyl-pentane diacid, 2-hexadecyl-pentane diacid, 2-octadecyl-pentane diacid, 2-eicosyl-pentane diacid, 2-docosyl-pentane diacid, 2-dodecyl-hexane diacid, 2-pentadecyl-hexane diacid, 2-octadecyl-hexane diacid, 2-eicosyl-hexane diacid, and 2-docosyl-hexane diacid.

In the present invention, as the aliphatic carboxylic acid compound for use in the color developer, tribasic acid compounds such as citric acid acylated by a long-chain aliphatic acid can also be employed. Specific examples of such compounds are as follows:

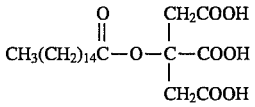

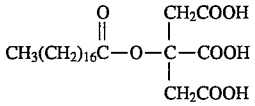

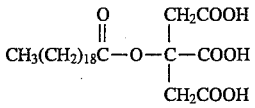

Furthermore, in the present invention, as the phenolic compound for use in the color developer, compounds represented by the following general formula (VII) can be employed:

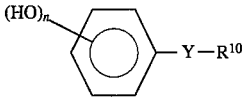

(VII)

wherein Y represents —S—, —O—, —CONH—, or —COO—; $R^{10}$ represents a straight chain or branched chain alkyl group or alkenyl group having 12 or more carbon atoms; and n is an integer of 1 to 3.

Specific examples of the phenolic compounds represented by general formula (VII) are as follows: p-(dodecylthio)phenol, p-(tetradecylthio)phenol, p-(hexadecylthio)phenol, p-(octadecylthio)phenol, p-(eicosylthio)phenol, p-(docosylthio)phenol, p-(tetracosylthio)phenol, p-(dodecyloxy)phenol, p-(tetradecyloxy)phenol, p-(hexadecyloxy)phenol, p-(octadecyloxy)phenol, p-(eicosyloxy)phenol, p-(docosyloxy)phenol, p-(tetracosyloxy)phenol, p-dodecylcarbamoylphenol, p-tetradecylcarbamoylphenol, p-hexadecylcarbamoylphenol, p-octadecylcarbamoylphenol, p-eicosylcarbamoylphenol, p-docosylcarbamoylphenol, p-tetracosylcarbamoylphenol, hexadecyl gallate, octadecyl gallate, eicosyl gallate, docosyl gallate, and tetracosyl gallate.

The reversible thermosensitive coloring composition of the present invention comprises as the main components the above-mentioned color developer and a coloring agent. As the coloring agent for use in the present invention, the following electron-donor compounds can be employed. These coloring agents are colorless or light-colored before the color formation is induced therein. Examples of such compounds are conventionally known triphenylmethane phthalide compounds, fluoran compounds, phenothiazine compounds, leuco auramine compounds and indolinophthalide compounds.

As preferable coloring agents for use in the present invention, the compounds represented by the following general formulas (VIII) and (IX) can be employed:

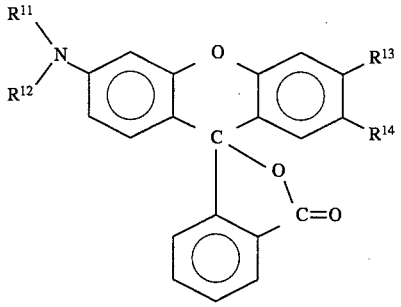

(VIII)

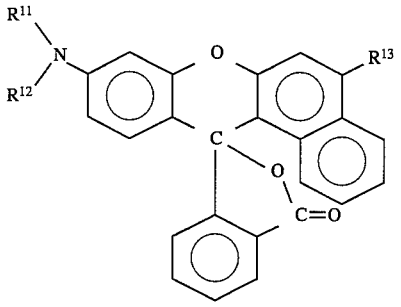

(IX)

wherein $R^{11}$ represents hydrogen or an alkyl group having 1 to 4 cabon atoms; $R^{12}$ represents an alkyl group having 1 to 6 carbon atoms, a cyclohexyl group, or a phenyl group which may have a substituent; $R^{13}$ represents hydrogen, an alkyl group or alkoxyl group having 1 to 2 carbon atoms, or halogen; and $R^{14}$ represents hydrogen, a methyl group, halogen, or an amino group which may have a substituent.

Examples of the substituent for the phenyl group are alkyl groups such as methyl group and ethyl group; alkoxyl groups such as methoxy group and ethoxy group; and halogen.

Examples of the substituent for the amino group are alkyl group, aryl group which may have a substituent, and aralkyl group which may have a substituent. The substituents for the aryl group or the aralkyl group can be selected from a group consisting of alkyl group, halogen and alkoxyl group.

Specific examples of such coloring agent's are as follows:

3-cyclohexylamino-6-chlorofluoran,
3-dimethylamino-5,7-dimethylfluoran,
3-diethylamino-7-chlorofluoran,
3-diethylamino-6-methyl-7-chlorofluoran,
3-diethylamino-6-methyl-7-(2', 4'-dimethylphenyl)aminofluoran,
3-(N-methyl-N-cyclohexyl)amino-6-methyl-7-phenylaminofluoran,
3-(N-propyl-N-methyl)amino-6-methyl-7-phenylaminofluoran,
3-diethylamino-6-methyl-7-phenylaminofluoran,
3-dibutylamino-6-methyl-7-phenylaminofluoran,
3-(N-n-propyl-N-isopropyl)amino-6-methyl-7-phenylaminofluoran,
3-(N-ethyl-N-sec-butyl)amino-6-methyl-7-phenylaminofluoran,
3-diethylamino-7-(m-trifluoromethylphenyl)aminofluoran,
3-(N-n-amyl-N-ethyl)amino-6-methyl-7-phenylaminofluoran,
3-n-octylamino-7-(p-chlorophenyl)aminofluoran,
3-n-palmitylamino-7-(p-chlorophenyl)aminofluoran,
3-di-n-octylamino-7-(p-chlorophenyl)aminofluoran,
3-(N-n-amyl-N-n-butyl)amino-7-(p-methylcarbonylphenyl)aminofluoran,
3-diethylamino-6-methyl-7-chlorofluoran, and
3-(N-ethyl-N-n-hexyl)amino-7-phenylaminofluoran.

Specific examples of the other coloring agents are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-6-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran, benzoyl leuco methylene blue,
6'-chloro-8'-methoxy-benzoindolino-spiropyran,
6'-bromo-2'-methoxy-benzoindolino-spiropyran,
3-(2'-hydroxy-4'-dimethoxyaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methoxyphenyl)phthalide,
3-morpholino-7-(N-propyl-trifluoromethylaniline)fluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran, 3-diethylamino-5-methyl-7-(α-phenylethylamino)fluoran,
3-diethylamino-7-piperidinofluoran,
3-(N-methyl-N-isopropylamino)-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-N-ethyl-N-(2-ethoxypropyl)amino-6-methyl-7-anilinofluoran,
3-N-ethyl-N-tetrahydrofurfurilamino-6-methyl-7-anilinofluoran,
3-diethylamino-6-methyl-7-mesidino-4',5'-benzofluoran,
3-N-methyl-N-isobutyl-6-methyl-7-anilinofluoran,
3-N-ethyl-N-isoamyl-6-methyl-7-anilinofluoran,
3-diethylamino-6-methyl-7-(2',4'-dimethylanilino)fluoran,
3,3-bis(p-dimethylaminophenyl)-6-chlorophthalide,
3-cyclohexylamino-6-chlorofluoran,
3-cyclohexylamino-6-bromofluoran,
3-diethylamino-7-chlorofluoran,
3-diethylamino-7-bromofluoran,
3-dipropylamino-7-chlorofluoran,
3-diethylamino-6-chloro-7-phenylamino-fluoran,
3-pyrrolidino-6-chloro-7-phenylamino-fluoran,
3-diethylamino-6-chloro-7-(m-trifluoromethylphenyl)amino-fluoran,
3-cyclohexylamino-6-chloro-7-(o-chlorophenyl)amino-fluoran,
3-diethylamino-6-chloro-7-(2',3'-dichlorophenyl)amino-fluoran,
3-diethylamino-6-methyl-7-chlorofluoran,
3-dibutylamino-6-chloro-7-ethoxyethylamino-fluoran,
3-diethylamino-7-(o-chlorophenyl)amino-fluoran,
3-diethylamino-7-(o-bromophenyl)amino-fluoran,
3-dibutylamino-7-(o-fluorophenyl)amino-fluoran,
3-(2'-methoxy-4'-dimethylaminophenyl)-3-(2'-hydroxy-4'-chloro-5'-chlorophenyl)phthalide,
3-(2'-hydroxy-4'-dimethylaminophenyl)-3-(2'-methoxy-5'-chlorophenyl)phthalide,
2-[3,6-bis(diethylamino)]-9-(o-chlorophenyl)amino-xanthylbenzoic acid lactam,
3-N-ethyl-N-isoamylamino-7-chlorofluoran,
3-diethylamino-6-methyl-7-m-trifluoromethylanilinofluoran,
3-pyrrolidino-6-methyl-7-m-trifluoromethylanilinofluoran,
3-(N-cyclohexyl-N-methyl)amino-6-methyl-7-m-trifluoromethylanilinofluoran,
3-morpholino-7-(N-n-propyl-N-m-trifluoromethylphenyl)amino-fluoran,
3-(N-methyl-N-phenylamino)-7-amino-fluoran,
3-(N-ethyl-N-phenylamino)-7-amino-fluoran,
3-(N-propyl-N-phenylamino)-7-amino-fluoran,
3-[N-methyl-N-(p-methylphenyl)amino]-7-amino-fluoran,
3-[N-ethyl-N-(p-methylphenyl)amino]-7-amino-fluoran,
3-[N-propyl-N-(p-methylphenyl)amino]-7-amino-fluoran,
3-[N-methyl-N-(p-ethylphenyl)amino]-7-amino-fluoran,
3-[N-ethyl-N-(p-ethylphenyl)amino]-7-amino-fluoran,
3-[N-propyl-N-(p-ethylphenyl)amino]-7-amino-fluoran,
3-[N-methyl-N-(2',4'-dimethylphenyl)amino]-7-amino-fluoran,
3-[N-ethyl-N-(2',4'-dimethylphenyl)amino]-7-amino-fluoran,
3-[N-propyl-N-(2',4'-dimethylphenyl)amino]-7-amino-fluoran,
3-[N-methyl-N-(p-chlorophenyl)amino]-7-amino-fluoran,
3-[N-ethyl-N-(p-chlorophenyl)amino]-7-amino-fluoran,
3-[N-propyl-N-(p-chlorophenyl)amino]-7-amino-fluoran,
3-(N-methyl-N-phenylamino)-7-methylamino-fluoran,
3-(N-ethyl-N-phenylamino)-7-methylamino-fluoran,
3-(N-propyl-N-phenylamino)-7-methylamino-fluoran,
3-[N-methyl-N-(p-methylphenyl)amino]-7-ethylamino-fluoran,
3-[N-ethyl-N-(p-methylphenyl)amino]-7-benzylamino-fluoran,
3-[N-methyl-N-(2',4'-dimethylphenyl)amino]-7-methylamino-fluoran,
3-[N-ethyl-N-(2',4'-dimethylphenyl)amino]-7-ethylamino-fluoran,
3-[N-methyl-N-(2',4'-dimethylphenyl)amino]-7-benzylamino-fluoran,
3-[N-ethyl-N-(2',4'-dimethylphenyl)amino]-7-benzylamino-fluoran,
3-(N-methyl-N-phenylamino)-7-dimethylamino-fluoran,
3-(N-ethyl-N-phenylamino)-7-dimethylamino-fluoran,
3-[N-methyl-N-(p-methylphenyl)amino]-7-diethylamino-fluoran,
3-[N-ethyl-N-(p-methylphenyl)amino]-7-diethylamino-fluoran,
3-(N-methyl-N-phenylamino)-7-dipropylamino-fluoran,
3-(N-ethyl-N-phenylamino)-7-dipropylamino-fluoran,
3-[N-methyl-N-(p-methylphenyl)amino]-7-dibenzylamino-fluoran,
3-[N-ethyl-N-(p-methylphenyl)amino]-7-dibenzylamino-fluoran,
3-[N-ethyl-N-(p-methylphenyl)amino]-7-di(p-methylbenzyl)-amino-fluoran,
3-[N-methyl-N-(p-methylphenyl)amino]-7-acetylamino-fluoran,
3-[N-ethyl-N-(p-methylphenyl)amino]-7-benzoylamino-fluoran,
3-[N-methyl-N-(p-methylphenyl)amino]-7-(o-methoxybenzoyl)-amino-fluoran,
3-[N-ethyl-N-(p-methylphenyl)amino]-6-methyl-7-phenylamino-fluoran,
3-[N-methyl-N-(p-methylphenyl)amino]-6-methyl-7-phenylamino-fluoran,
3-[N-methyl-N-(p-methylphenyl)amino]-6-tert-butyl-7-(p-methylphenyl)amino-fluoran,
3-(N-ethyl-N-phenylamino)-6-methyl-7-[N-ethyl-N-(p-methylphenyl)amino]-fluoran,
3-[N-propyl-N-(p-methylphenyl)amino]-6-methyl-7-[N-methyl-N-(p-methylphenyl)amino]-fluoran,
3-[N-ethyl-N-(p-methylphenyl)amino]-5-methyl-7-benzylamino-fluoran,
3-[N-ethyl-N-(p-methylphenyl)amino]-5-chloro-7-dibenzylamino-fluoran,
3-[N-methyl-N-(p-methylphenyl)amino]-5-methoxy-7-dibenzylamino-fluoran,
3-[N-ethyl-N-(p-methylphenyl)amino]-6-methyl-fluoran,
3-[N-ethyl-N-(p-methylphenyl)amino]-5-methoxy-fluoran,
3-diethylamino-7,8-benzofluoran,
3-(N-ethyl-N-isoamylamino)-7,8-benzofluoran,
3-(N-ethyl-N-n-octylamino)-7,8-benzofluoran,
3-N,N-dibutylamino-7,8-benzofluoran,
3-(N-methyl-N-cyclohexylamino)-7,8-benzofluoran,
3-(N-ethyl-N-p-methylphenylamino)-7,8-benzofluoran,
3-N,N-diallylamino-7,8-benzofluoran, and
3-(N-ethoxyethyl-N-ethylamino)-7,8-benzofluoran.

In the present invention, a variety of low-melting point organic compounds and high-melting point organic compounds can be employed as the decolorization-accelerating agent.

Examples of the decolorization-accelerating agent for use in the present invention include a fatty acid, a fatty acid derivative, a fatty acid metal salt, a wax, a fat and oil, a higher alcohol, a phosphoric acid ester, a benzoic acid ester, a phthalic acid ester, a hydroxy acid ester, a silicone oil, a liquid crystalline compound, and a surface active agent. The examples of each group are as follows.

(1) Fatty acid, fatty acid derivative and fatty acid metal salt

Examples of the fatty acid used as the decolorization-accelerating agent for use in the present invention are unsaturated or saturated monobasic acids; and unsaturated or saturated polybasic acids such as dibasic acids.

For example, saturated fatty acids such as decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, docosanoic acid, tetracosanoic acid, hexacosanoic acid, and octacosanoic acid; unsaturated fatty acids such as oleic acid, elaidic acid linoleic acid, sorbic acid, and stearolic acid; and dibasic acids such as dodecanedioic acid, tetradecanedioic acid, hexadecanedioic acid, and octadecanedioic acid can be employed.

Examples of the fatty acid derivative include an ester of a fatty acid and a monohydric or polyhydric alcohol, and an amide, anilide, hydrazide, ureido and anhydride of a fatty acid.

Specific example of the fatty acid ester for use in the present invention are methyl ester, ethyl ester, propyl ester, butyl ester, hexyl ester, octyl ester, decyl ester, dodecyl ester, tetradecyl ester, hexadecyl ester, octadecyl ester, eicosyl ester, and cholesterol ester of the above-mentioned fatty acids.

Specific examples of the ester of the fatty acid and the polyhydric alcohol include monoglyceride, diglyceride, and triglyceride of the above-mentioned fatty acids.

Examples of the fatty acid metal salt are sodium, pottasium, calcium, magnesium, zinc, iron, nickel, and copper salts of the above-mentioned fatty acids.

(2) Wax, and fat and oil

Examples of the wax for use in the decolorization-accelerating agent are vegetable waxes such as candelilla wax, carnauba wax, rice wax and Japan wax; animal waxes such as beeswax and whale wax; mineral waxes such as montan wax, ozokerite and ceresin; petroleum waxes such as paraffin wax, microcrystalline wax and petrolatum; and synthetic waxes such as Fischer—Tropsch wax, polyethylene wax, polypropylene wax, modified wax, stearic acid amide, and phthalic anhydride imide.

Examples of the paraffin are n-alkanes such as tetracosane, pentacosane, hexacosane, heptacosane, octacosane, nonacosane, triacontane, dotriacontane, tetratriacontane, hexatriacontane, octatriacontane, tetracontane; and paraffins containing as the main components these n-alkanes.

Examples of the fat and oil are soybean oil, coconut oil, linseed oil, lanolin, cottonseed oil, rape oil, castor oil, whale oil, beef tallow and hardened oil.

(3) Higher alcohol

Specific examples of the higher alcohol are tridecyl alcohol, tetradecyl alcohol, pentadecyl alcohol, hexadecyl alcohol, heptadecyl alcohol, octadecyl alcohol, nanodecyl alcohol, eicosyl alcohol, phytol, ceryl alcohol and melissyl alcohol.

(4) Phosphoric acid esters, benzoic acid esters, phthalic acid esters and hydroxy acid esters Examples of the phosphoric acid ester are tributyl phosphate, tri-2-ethylhexyl phosphate, triphenyl phosphate and tricresyl phosphate.

Examples of the benzoic acid ester are methyl benzoate, ethyl benzoate and butyl benzoate.

Examples of the phthalic acid ester are dimethyl phthalate, diethyl phthalate, diheptyl phthalate, di-n-octyl phthalate, 2-ethylhexyl phthalate, diisononyl phthalate, octyldecyl phthalate, diisodecyl phthalate, and butylbenzyl phthalate.

Examples of the hydroxy acid ester are methyl acetylricinoleate, butyl acetylricinoleate, butylphthalyl butylglycolate and tributyl acetylcitrate.

(5) Silicone oil

In the present invention, conventionally known silicone oils can be used as the decolorization-accelerating agent in the reversible thermosensitive coloring composition.

Specific examples of the silicone oil are dimethyl silicone oil, methylphenyl silicone oil, alkyl-modified silicone oil, polyether-modified silicone oil, alcohol-modified silicone oil, fluorine-modified silicone oil, amino-modified silicone oil, epoxy-modified silicone oil, carboxyl-modified silicone oil, and terminal reactive silicone oil.

(6) Liquid crystalline compound

The liquid crystalline compound used as the decolorization-accelerating agent in the present invention can be selected from the conventionally known liquid crystalline compounds of nematic state type, cholesteric state type, and smectic state type. Specifically, Shiff base compounds, azo compounds, azoxy compounds, benzoic acid ester compounds, biphenyl compounds, phenylcyclohexane compounds, pyrimidine compounds, dioxane compounds, cholesteryl compounds, and terphenyl compounds are usable.

(7) Surface active agent

In the present invention, commercially available surface-active agents can be employed as the decolorization-accelerating agent. The commercially available anionic surface active agent, cationic surface active agent, nonionic surface active agent, and amphoteric surface active agent can be used alone or in combination. Specific examples of the commercially available surface active agent for use in the present invention are "Spamine" (Trademark), made by Miyoshi Oil & Fat Co., Ltd., "Neopelex" (Trademark), made by Kao Corporation, "Penestroll" (Trademark), made by Tokai Ind. Co., Ltd., "Sofnon" (Trademark), made by Toho Chemical Industry Co., Ltd., "Softamine" (Trademark), made by Chukyo Yushi Co., Ltd., "Softex KV" (Trademark), made by Kao Corporation, "Lightfix" (Trademark), made by Kyoeisha Chemical Co., Ltd., "Emurocks" (Trademark), made by Yoshimura Oil Chemistry Co., Ltd., "Lipanol" (Trademark), made by Lion Co., Ltd., and "Lipomine SA" (Trademark), made by Lion Co., Ltd.

The decolorization-accelerating agent contained in the reversible thermosensitive coloring composition according to the present invention is not limited by the previously mentioned compounds, and a variety of compounds such as a plasticizer for polymeric materials, and a material serving as nuclei for crystallization can also be employed as the decolorization-accelerating agent.

Specific examples of the material serving as nuclei for crystallization are dibenzylidene sorbitols such as p-methyldibenzylidene sorbitol, dimethyldibenzylidene sorbitol, and p-ethyldibenzylidene sorbitol; condensates of D-sorbitol and benzaldehyde; and higher fatty acid amides.

The previously mentioned compounds can be used alone or in combination as the decolorization-accelerating agent for use in the present invention. Further, it is preferable that the amount of the decolorization-accelerating agent contained in the coloring composition of the present invention be in the range of 0.5 to 50 wt. % of the entire weight of the color developer. When the amount of the decolorization-accelerating agent is within the above range, a satisfactory decolorization-accelerating effect can be obtained, and the color development state can be sufficiently maintained for practical use.

In the present invention, it is preferable that the compound contained as the decolorization-accelerating agent in the reversible thermosensitive coloring composition be dispersed in the coloring composition in the color development state, forming minute domains therein, when fused together with the color developer and the coloring agent under application of heat thereto to a color development initiation temperature, and thereafter promptly cooled. In order to obtain such a dispersed condition, it is preferable to employ as a decolorization-accelerating agent a compound with the long-chain structure in its molecule as well as the color developer. More specifically, the compound having a saturated hydrocarbon chain with 10 or more carbon atoms in its molecule is suitable for the decolorization-accelerating agent for use in the present invention.

In the reversible thermosensitive coloring composition of the present invention, the coloring agent may be used with the color developer in an appropriate ratio depending upon the physical properties of each compound employed. It is preferable that the molar ratio of the coloring agent to the color developer be in the range of (1:1) to (1:20), and more preferably in the range of (1:2) to (1:10), to obtain a sufficient color development density for use in practice.

Even if the molar ratio of the coloring agent to the color developer is in the above-mentioned preferable range, the decolorization characteristics vary depending on the delicate mixing ratio of the coloring agent and the color developer. When the amount of the color developer is relatively large, the decolorization initiation temperature tends to be lowered, while when the amount of the color developer is relatively small, the decolorization becomes sensitive to the changes in temperature. Therefore, the amount ratio of the coloring agent to the color developer may be appropriately determined with the application and the purpose of usage taken into consideration.

Additives for controlling the crystallization of the color developer may be added to the reversible thermosensitive coloring composition of the present invention for improving the decolorization properties and the preservability thereof.

A reversible thermosensitive coloring recording medium according to the present invention, which utilizes the above discussed reversible thermosensitive coloring composition, will now be explained.

Figure 2:
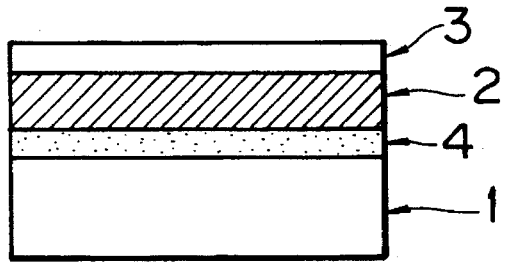
FIG. 2 is a schematic cross-sectional view of one embodiment of a reversible thermosensitive coloring recording medium according to the present invention.

FIG. 2 is a cross-sectional view showing one example of a reversible thermosensitive coloring recording medium of the present invention, which comprises a support 1, an undercoat layer 4 formed thereon, a reversible thermosensitive recording layer 2 comprising the reversible thermosensitive coloring composition according to the present invention overlaid on the undercoat layer 4, and a protective layer 3 formed on the reversible thermosensitive recording layer 2.

Any materials which can support the recording layer 2 thereon can be employed as the materials for the support 1. For example, a sheet of paper or synthetic paper, a plastic film, a composite film thereof, and a glass plate can be employed.

The recording layer can be in any form as long as the previously mentioned reversible thermosensitive coloring composition is contained therein. If necessary, a binder resin may be added to the recording layer in order to hold the color developer and the coloring agent in the form of a layer.

As the binder resin, for example, polyvinyl chloride, polyvinyl acetate, vinyl chloride—vinyl acetate copolymer, polystyrene, styrene copolymers, phenoxy resin, polyester, aromatic polyester, polyurethane, polycarbonate, polyacrylic acid ester, polymethacrylic acid ester, acrylic acid copolymer, maleic acid copolymer, and polyvinyl alcohol can be employed.

Moreover, micro-capsuled color developers and coloring agents can be employed. The color developers and coloring agents can be micro-capsuled by conventional methods such as the coacervation method, the interfacial polymerization method, or the in-situ polymerization method.

The recording layer can be formed by a conventional method. More specifically, a coloring agent and a color developer are uniformly dispersed or dissolved in water or in an organic solvent, together with a binder resin to prepare a coating liquid. The thus prepared coating liquid is coated on the support and dried, whereby a recording layer is formed.

When no binder resin is employed, a mixture of the color developer and the coloring agent is fused and formed into a film, and the thus obtained film is then cooled to prepare the recording layer.

The binder resin employed in the recording layer serves to maintain the reversible thermosensitive coloring composition in a uniformly dispersed state in the recording layer even when the color development and the decolorization are repeated. In particular, the problem of ununiformity in the coloring composition is produced because of the coalescence therein under application of heat in the color development process. Therefore, the binder resin with high heat resistance is preferably used.

Additionally, the light-resistance of the reversible thermosensitive coloring recording medium of the present invention can be improved by addition of a light stabilizer to the recording layer. As the light stabilizer for use in the present invention, an ultraviolet absorber, an antioxidant, an anti-aging agent, a singlet-oxygen quenching agent, a superoxide-anion quenching agent can be employed.

A reversible thermosensitive recording method using the reversible thermosensitive recording medium according to the present invention will now be explained. In a step to allow the recording medium to assume a color development state, the recording layer is temporarily heated to a color development initiation temperature which is above the melting point of the mixture of the coloring agent and the color developer in the recording layer. In a step to allow the recording medium to assume a decolorization state, the coloring composition in the color development state which is contained in the recording layer is heated to a decolorization initiation temperature which is below the above-mentioned color development initiation temperature.

To record an image on the recording medium, an image in the color development state may be displayed on the background in the decolorization state, or an image in the decolorization state may be recorded on the background in the color development state. In any case, when heat is imagewise applied to the recording medium, a heating means capable of partially applying heat to the recording medium, such as a hot-pen, a thermal head, or a laser beam is usable.

In the case where the entire surface of the recording medium is subjected to the color development treatment or the decolorization treatment, the recording medium may be brought into contact with a heat roller or a heat plate, or exposed to hot air, or placed in a heated temperature-controlled chamber, or irradiated by an infrared ray. Alternatively, heat can be applied to the entire surface of the recoding medium by a thermal head.

[EXAMPLE 1-1]

A mixture of the following components including a reversible thermosensitive coloring composition was dispersed and pulverized in a ball mill so as to have a particle diameter of 1 to 4 μm, so that a reversible thermosensitive recording layer coating liquid was prepared:

| | Parts by Weight |
|---|---|
| Vinyl chloride-vinyl acetate copolymer (Trademark "VYHH", made by Union Carbide Japan K.K.) | 45 |
| Toluene | 200 |
| Methyl ethyl ketone | 200 |
| (Reversible thermosensitive coloring composition) | |
| 3-dibutylamino-7-(o-chlorophenyl)amino-fluoran (Coloring agent) | 10 |
| Octadecylphosphonic acid (Color developer) | 30 |
| Lignoceric acid (Decolorization-accelerating agent) | 3 |

The thus prepared reversible thermosensitive recording layer coating liquid was coated by a wire bar on a polyester film with a thickness of about 100 μm, serving as a support, and dried, so that a reversible thermosensitive recording layer with a thickness of about 6 μm was formed on the support. Thus, a reversible thermosensitive coloring recording medium No. 1-1 according to the present invention was prepared.

[EXAMPLES 1-2 to 1-22]

The procedure for preparation of the reversible thermosensitive coloring recording medium No. 1-1 according to the present invention was repeated except that the reversible thermosensitive coloring composition employed in Example 1-1 was replaced by a reversible thermosensitive coloring composition as shown in Table 1, whereby reversible thermosensitive coloring recording media No. 1-2 to No. 1-22 according to the present invention were obtained.

TABLE 1

| Example No. | Coloring Agent | Color Developer | Decolorization-accelerating Agent |
|---|---|---|---|
| Ex. 1-2 | 3-dibutylamino-7-(o-chlorophenyl) aminofluoran 10 parts | Octadecyl-phosphonic acid 30 parts | Behenic acid 3 parts |
| Ex. 1-3 | 3-dibutylamino-7-(o-chlorophenyl) aminofluoran 10 parts | Hexadecyl-phosphonic acid 30 parts | Behenic acid 3 parts |
| Ex. 1-4 | 3-dibutylamino-7-(o-chlorophenyl) aminofluoran 10 parts | Eicosyl-phosphonic acid 30 parts | Cerotic acid 3 parts |
| Ex. 1-5 | 3-dibutylamino-7-(o-chlorophenyl) aminofluoran 10 parts | Docosyl-phosphonic acid 30 parts | Hexadecane-dioic acid 3 parts |
| Ex. 1-6 | 3-dibutylamino-7-(o-chlorophenyl) aminofluoran 10 parts | Eicosyl-thiomalic acid 30 parts | Eicosanedioic acid 3 parts |
| Ex. 1-7 | 3-dibutylamino-6-methyl-7-phenyl-aminofluoran 10 parts | Eicosyl-thiomalic acid 30 parts | Behenic acid 3 parts |
| Ex. 1-8 | 3-{N-ethyl-N-(p-methylphenyl)-amino}-6-methyl-7-phenylamino-fluoran 10 parts | Eicosyl-thiomalic acid 30 parts | 16-hydroxy-hexadecanoic acid 2 parts |
| Ex. 1-9 | 3-dibutylamino-7-(o-chlorophenyl)-aminofluoran 10 parts | α-hydroxy-hexadecanoic acid 30 parts | 12-hydroxy-stearic acid 2 parts |
| Ex. 1-10 | 3-dibutylamino-7-(o-chlorophenyl)-aminofluoran 10 parts | Octadecyl-malonic acid 30 parts | Magnesium stearate 3 parts |
| Ex. 1-11 | 3-diethylamino-7-(o-chlorophenyl)-aminofluoran 10 parts | Octadecyl-phosphonic acid 30 parts | Calcium stearate 4.5 parts |
| Ex. 1-12 | 3-diethylamino-7-(o-chlorophenyl)-aminofluoran 10 parts | Octadecyl-phosphonic acid 30 parts | Cholesterol enanthate 1.5 parts |
| Ex. 1-13 | 3-dibutylamino-7-(o-chlorophenyl)-aminofluoran 10 parts | Octadecyl-phosphonic acid 30 parts | Cholesterol stearate 3 parts |
| Ex. 1-14 | 3-{N-ethyl-N-(p-methylphenyl)-amino}-6-methyl-7-phenylamino-fluoran 10 parts | Octadecyl-phosphonic acid 30 parts | Azoxybenzene-4,4'-dicar-boxylic acid diethyl ester 2 parts |
| Ex. 1-15 | 3-{N-ethyl-N-(p-methylphenyl)-amino}-6-methyl-7-phenylamino-fluoran 10 parts | Octadecyl-phosphonic acid 30 parts | Bis(p-methyl-benzylidene sorbitol 3 parts |
| Ex. 1-16 | 3-dibutylamino-7-(o-chlorophenyl)-aminofluoran 10 parts | Octadecyl-phosphonic acid 30 parts | Sodium bis(4-t-butyl-phenyl)phos-phoric acid 3 parts |
| Ex. 1-17 | 3-dibutylamino-6-methyl-7-phenyl-aminofluoran 10 parts | Eicosyl-thiomalic acid 30 parts | Cholesterol stearate 1.5 parts |
| Ex. 1-18 | 3-dibutylamino-6-methyl-7-phenyl-aminofluoran 10 parts | Eicosyl-thiomalic acid 30 parts | p-chlorophenyl benzoate 2 parts |
| Ex. 1-19 | 3-dibutylamino-6-methyl-7-phenyl-aminofluoran 10 parts | Eicosyl-thiomalic acid 30 parts | Bis(p-ethyl benzylidene) sorbitol 3 parts |
| Ex. 1-20 | 3-dibutylamino-7-(o-chlorophenyl)-aminofluoran 10 parts | Octadecyl-malonic acid 30 parts | Cholesterol caprylate 1.5 parts |
| Ex. 1-21 | 3-dibutylamino-7-(o-chlorophenyl)-aminofluoran 10 parts | Octadecyl-malonic acid 30 parts | Tetradecane-dioic acid 6 parts |
| Ex. 1-22 | 3-dibutylamino-7-(o-chlorophenyl)-aminofluoran 10 parts | Octadecyl-malonic acid 30 parts | 2-naphthyl benzoate 2 parts |

[Comparative Example 1-1]

A mixture of the following components including a reversible thermosensitive coloring composition was dispersed and pulverized in a ball mill so as to have a particle diameter of 1 to 4 μm, so that a reversible thermosensitive recording layer coating liquid was prepared:

| | Parts by Weight |
|---|---|
| Vinyl chloride-vinyl acetate copolymer (Trademark "VYHH", made by Union Carbide Japan K.K.) | 45 |
| Toluene | 200 |
| Methyl ethyl ketone | 200 |
| (Reversible thermosensitive coloring composition) | |
| 3-dibutylamino-7-(o-chlorophenyl)amino-fluoran (Coloring agent) | 10 |
| Octadecylphosphonic acid (Color developer) | 30 |

The thus prepared reversible thermosensitive recording layer coating liquid without the decolorization-accelerating agent, was coated by a wire bar on a polyester film with a thickness of about 100 μm, serving as a support, and dried, so that a reversible thermosensitive recording layer with a thickness of about 6 82 m was formed on the support. Thus, a comparative reversible thermosensitive coloring recording medium No. 1-1 was prepared.

[Comparative Examples 1-2 to 1-4]

The procedure for preparation of the comparative reversible thermosensitive coloring recording medium No. 1-1 was repeated except that the reversible thermosensitive coloring composition employed in Comparative Example 1-1 was replaced by a reversible thermosensitive coloring composition as shown in Table 2, whereby comparative reversible thermosensitive coloring recording media No. 1-2 to No. 1-4 were prepared.

TABLE 2

| Comp. Ex. No. | Coloring Agent | Color Developer | Decolorization-accelerating Agent |
|---|---|---|---|
| Comp. Ex. 1-2 | 3-dibutylamino-7-(o-chlorophenyl)-aminofluoran 10 parts | Eicosyl-phosphonic acid 30 parts | — |
| Comp. Ex. 1-3 | 3-dibutylamino-7-(o-chlorophenyl)-aminofluoran 10 parts | Eicosyl-thiomalic acid 30 parts | — |
| Comp. Ex. 1-4 | 3-dibutylamino-7-(o-chlorophenyl)-aminofluoran 10 parts | Octadecyl-malonic acid 30 parts | — |

Each of the above prepared reversible thermosensitive coloring recording media No. 1-1 to No. 1-22 according to the present invention and comparative reversible thermosensitive coloring recording media No. 1-1 to No. 1-4 was heated on a hot plate at 125° C. for 30 sec and was promptly cooled to 0° C. from the back surface of the recording medium, that is, the support side of the recording medium to cause the recording medium to assume a color development state. The color development density of each recording medium in the above state was measured by use of Macbeth densitometer RD-918, which density was defined as an initial color development density of the recording medium.

Thereafter, to decolorize the colored recording medium, each reversible thermosensitive coloring recording medium in the color development state was put in a constant temperature bath for 20 sec, the temperature of which was controlled at a predetermined decolorization treatment temperature shown in Table 3 and then taken out from the bath to measure the density of the recording medium. This density of the recording medium after decolorization treatment was defined as a decolorized density. The initial color development density and the decolorized density of each reversible thermosensitive coloring recording medium are shown in Table 3.

TABLE 3

| Example No. | Initial Color Development Density | Decolorized Density | Decolorization Treatment Temperature (°C.) |
|---|---|---|---|
| Ex. 1-1 | 1.91 | 0.14 | 70 |
| Ex. 1-2 | 1.90 | 0.14 | 70 |
| Ex. 1-3 | 1.78 | 0.14 | 65 |
| Ex. 1-4 | 1.94 | 0.13 | 75 |
| Ex. 1-5 | 1.97 | 0.16 | 80 |
| Ex. 1-6 | 2.05 | 0.16 | 60 |
| Ex. 1-7 | 2.03 | 0.15 | 60 |
| Ex. 1-8 | 2.08 | 0.14 | 60 |
| Ex. 1-9 | 1.68 | 0.14 | 70 |
| Ex. 1-10 | 1.83 | 0.16 | 70 |
| Ex. 1-11 | 1.90 | 0.16 | 70 |
| Ex. 1-12 | 1.81 | 0.13 | 70 |
| Ex. 1-13 | 1.90 | 0.14 | 70 |
| Ex. 1-14 | 1.88 | 0.15 | 70 |
| Ex. 1-15 | 1.90 | 0.14 | 70 |
| Ex. 1-16 | 1.87 | 0.13 | 70 |
| Ex. 1-17 | 1.82 | 0.13 | 60 |
| Ex. 1-18 | 1.82 | 0.15 | 60 |
| Ex. 1-19 | 1.91 | 0.14 | 60 |
| Ex. 1-20 | 1.85 | 0.13 | 70 |
| Ex. 1-21 | 1.96 | 0.16 | 70 |
| Ex. 1-22 | 1.84 | 0.15 | 70 |
| Comp. Ex. 1-1 | 1.85 | 0.19 | 70 |
| Comp. Ex. 1-2 | 1.88 | 0.21 | 75 |
| Comp. Ex. 1-3 | 1.80 | 0.27 | 60 |
| Comp. Ex. 1-4 | 1.76 | 0.20 | 70 |

As can be seen from the results shown in the above Table 3, the decolorized densities of the reversible thermosensitive coloring recording media according to the present invention are lower than those of the comparative reversible thermosensitive coloring recording media because the recording media of the present invention comprise the decolorization-accelerating agent. It is confirmed by the above fact that the decolorization was more successfully performed in the reversible thermosensitive coloring recording media according to the present invention than in the comparative recording media.

[EXAMPLE 2-1]

A mixture of the following components including a reversible thermosensitive coloring composition was dispersed and pulverized in a ball mill so as to have a particle diameter of 1 to 4 μm, so that a reversible thermosensitive recording layer coating liquid was prepared:

| | Parts by Weight |
|---|---|
| Vinyl chloride-vinyl acetate | 45 |

-continued

| | Parts by Weight |
|---|---|
| copolymer (Trademark "VYHH", made by Union Carbide Japan K.K.) | |
| Toluene | 200 |
| Methyl ethyl ketone | 200 |
| (Reversible thermosensitive coloring composition) | |
| 3-dibutylamino-7-(o-chlorophenyl)amino-fluoran (Coloring agent) | 10 |
| Hexadecylphosphonic acid (Color developer) | 30 |
| Dodecyl Stearate (Decolorization-accelerating agent) | 1.5 |

The thus prepared reversible thermosensitive recording layer coating liquid was coated by a wire bar on a polyester film with a thickness of about 100 μm, serving as a support, and dried, so that a reversible thermosensitive recording layer with a thickness of about 6 μm was formed on the support. Thus, a reversible thermosensitive coloring recording medium No. 2-1 according to the present invention was prepared.

[EXAMPLES 2-2 to 2-41]

The procedure for preparation of the reversible thermosensitive coloring recording medium No. 2-1 according to the present invention was repeated except that the reversible thermosensitive coloring composition employed in Example 2-1 was replaced by a reversible thermosensitive coloring composition as shown in Table 4, whereby reversible thermosensitive coloring recording media No. 2-2 to No. 2-41 according to the present invention were obtained.

TABLE 4

| Example No. | Coloring Agent | Color Developer | Decolorization-accelerating Agent |
|---|---|---|---|
| Ex. 2-2 | 3-dibutylamino-7-(o-chlorophenyl)-aminofluoran 10 parts | Octadecyl-phosphonic acid 30 parts | Methyl lignocerate 1.5 parts |
| Ex. 2-3 | 3-dibutylamino-7-(o-chlorophenyl)-aminofluoran 10 parts | Eicosyl-phosphonic acid 30 parts | Methyl behenate 2 parts |
| Ex. 2-4 | 3-dibutylamino-7-(o-chlorophenyl)-aminofluoran 10 parts | Docosyl-phosphonic acid 30 parts | Stearyl stearate 3 parts |
| Ex. 2-5 | 3-dibutylamino-6-methyl-7-phenyl-aminofluoran 10 parts | Eicosyl-thiomalic acid 30 parts | Dodecyl stearate 3 parts |
| Ex. 2-6 | 3-dibutylamino-7-(o-chlorophenyl)-aminofluoran 10 parts | Octadecyl-malonic acid 30 parts | Dodecyl stearate 2 parts |
| Ex. 2-7 | 3-dibutylamino-7-(o-chlorophenyl)-aminofluoran 10 parts | Octadecyl-phosphonic acid 30 parts | Triphenyl phosphate 5 parts |
| Ex. 2-8 | 3-{N-ethyl-N-(p-methylphenyl)-amino}-6-methyl-7-phenylamino-fluoran 10 parts | Octadecyl-phosphonic acid 30 parts | Diethyl isophthalate 5 parts |
| Ex. 2-9 | 3-{N-ethyl-N-(p-methylphenyl)-amino}-6-methyl-7-phenylamino-fluoran 10 parts | Octadecyl-phosphonic acid 30 parts | Dicyclohexyl phthalate 6 parts |
| Ex. 2-10 | 3-{N-ethyl-N-(p-methylphenyl)-amino}-6-methyl-7-phenylamino-fluoran 10 parts | Octadecyl-phosphonic acid 30 parts | Stearyl alcohol 1.5 parts |
| Ex. 2-11 | 3-diethylamino-7-(o-chlorophenyl)-aminofluoran 10 parts | Octadecyl-phosphonic acid 30 parts | Lauric acid 3 parts |
| Ex. 2-12 | 3-diethylamino-7-(o-chlorophenyl)-aminofluoran 10 parts | Octadecyl-phosphonic acid 30 parts | Myristic acid 3 parts |
| Ex. 2-13 | 3-dibutylamino-7-(o-chlorophenyl)-aminofluoran 10 parts | Docosyl-phosphonic acid 30 parts | Polyethylene wax 2 parts |
| Ex. 2-14 | 3-dibutylamino-7-(o-chlorophenyl)-aminofluoran 10 parts | Docosyl-phosphonic acid 30 parts | Carnauba wax 3 parts |
| Ex. 2-15 | 3-dibutylamino-7-(o-chlorophenyl)-aminofluoran 10 parts | Docosyl-phophonic acid 30 parts | Polyoxy-ethylene derivative ("Emulgen A-500 (Trademark), made by Kao Corporation) 2 parts |
| Ex. 2-16 | 3-dibutylamino-7-(o-chlorophenyl)-aminofluoran 10 parts | Octadecyl-malonic acid 30 parts | Polyoxy-ethylene sorbitan mono-stearate ("Rheodol TW-S106" (Trademark), made by Kao Corporation) 2 parts |
| Ex. 2-17 | 3-dibutylamino-6-methyl-7-phenyl-aminofluoran 10 parts | Eicosyl-thiomalic acid 30 parts | Palmitic acid 3 parts |
| Ex. 2-18 | 3-dibutylamino-6-methyl-7-phenyl-aminofluoran 10 parts | Eicosyl-thiomalic acid 30 parts | Polyoxy-ethylene lauryl ether ("Emulgen 123P" (Trademark), made by Kao Corporation) 2 parts |
| Ex. 2-19 | 3-diethylamino-7-(o-chlorophenyl)-aminofluoran 10 parts | Eicosyl-thiomalic acid 30 parts | Beeswax 2 parts |
| Ex. 2-20 | 3-diethylamino-7-(o-chlorophenyl)-aminofluoran 10 parts | Eicosyl-thiomalic acid 30 parts | Hexadecanol 1.5 parts |
| Ex. 2-21 | 3-dibutylamino-7-(o-chlorophenyl)-aminofluoran 10 parts | Octadecylphos-phonic acid 30 parts | Stearyl stearate 3 parts |
| Ex. 2-22 | 3-dibutylamino-7-(o-chlorophenyl)-aminofluoran 10 parts | Octadecylphos-phonic acid 30 parts | Dodecyl stearate 3 parts |
| Ex. 2-23 | 3-diethylamino-7-(o-chlorophenyl)- | Octadecylphos-phonic acid | Tributyl phosphate |

TABLE 4-continued

| Example No. | Coloring Agent | Color Developer | Decolorization-accelerating Agent |
|---|---|---|---|
| | aminofluoran 10 parts | 30 parts | 1.5 parts |
| Ex. 2-24 | 3-diethylamino-7-(o-chlorophenyl)-aminofluoran 10 parts | Octadecylphosphonic acid 30 parts | Di-n-octyl phthalate 1.5 parts |
| Ex. 2-25 | 3-dibutylamino-7-(o-chlorophenyl)-aminofluoran 10 parts | Eicosylphosphonic acid 30 parts | Dibutyl adipate 1 part |
| Ex. 2-26 | 3-dibutylamino-7-(o-chlorophenyl)-aminofluoran 10 parts | Eicosylphosphonic acid 30 parts | Butyl acetylricinoleate 2 parts |
| Ex. 2-27 | 3-dibutylamino-7-(o-chlorophenyl)-aminofluoran 10 parts | Octadecylphosphonic acid 30 parts | Castor oil 2 parts |
| Ex. 2-28 | 3-dibutylamino-6-methyl-7-phenylaminofluoran 10 parts | Docosylphosphonic acid 30 parts | Lanolin 2 parts |
| Ex. 2-29 | 3-dibutylamino-7-(o-chlorophenyl)-aminofluoran 10 parts | Octadecylphosphonic acid 30 parts | Silicone oil ("KF-50" (Trademark), made by Shin-Etsu Chemical Co., Ltd) 1.5 parts |
| Ex. 2-30 | 3-dibutylamino-7-(o-chlorophenyl)-aminofluoran 10 parts | Eicosylphosphonic acid 30 parts | Polyether-modified silicone oil ("SF-8427" (Trademark), made by Dow Corning Toray Silicone Co., Ltd.) 1.5 parts |
| Ex. 2-31 | 3-dibutylamino-7-(o-chlorophenyl)-aminofluoran 10 parts | Docosylphosphonic acid 30 parts | Epoxy-modified silicone oil ("SF-8411" (Trademark), made by Dow Corning Toray Silicone Co., Ltd.) 1.5 parts |
| Ex. 2-32 | 3-{N-ethyl-N-(p-methylphenyl)-amino}-6-methyl-7-phenylaminofluoran 10 parts | Octadecylphosphonic acid 30 parts | Polyethylene glycol monolaurate ("Emunorn" (Trademark), made by Kao Corporation) 2 parts |
| Ex. 2-33 | 3-{N-ethyl-N-(p-methylphenyl)-amino}-6-methyl-7-phenylaminofluoran 10 parts | Eicosylphosphonic acid 30 parts | Sorbitan monolaurate ("Rheodol SP-L10" (Trademark), made by Kao Corporation) 2 parts |
| Ex. 2-34 | 3-{N-ethyl-N-(p-methylphenyl)-amino}-6-methyl-7-phenylaminofluoran 10 parts | Octadecylphosphonic acid 30 parts | Lauryl alcohol 1 part |
| Ex. 2-35 | 3-dibutylamino-6-methyl-7-phenylaminofluoran 10 parts | Eicosylthiomalic acid 30 parts | Di-n-octyl phthalate 2 parts |
| Ex. 2-36 | 3-dibutylamino-6-methyl-7-phenylaminofluoran 10 parts | Eicosylthiomalic acid 30 parts | Castor oil 3 parts |
| Ex. 2-37 | 3-dibutylamino-6-methyl-7-phenylaminofluoran 10 parts | Eicosylthiomalic acid 30 parts | Silicone oil ("KF-92" (Trademark), made by Shin-Etsu Chemical Co., Ltd.) 1.5 parts |
| Ex. 2-38 | 3-{N-ethyl-N-(p-methylphenyl)-amino}-6-methyl-7-phenylaminofluoran 10 parts | Eicosylthiomalic acid 30 parts | Polyoxyethylene lauryl ether ("Emulgen 104P" (Trademark), made by Kao Corporation) 1.5 parts |
| Ex. 2-39 | 3-{N-ethyl-N-(p-methylphenyl)-amino}-6-methyl-7-phenylaminofluoran 10 parts | Eicosylthiomalic acid 30 parts | Lauryl alcohol 1 part |
| Ex. 2-40 | 3-dibutylamino-7-(o-chlorophenyl) aminofluoran 10 parts | Octadecylmalonic acid 30 parts | n-hexyl benzoate 2 parts |
| Ex. 2-41 | 3-dibutylamino-7-(o-chlorophenyl)-aminofluoran 10 parts | Octadecylmalonic acid 30 parts | Butyl acetylricinoleate 1.5 parts |

[Comparative Example 2-1]

A mixture of the following components including a reversible thermosensitive coloring composition was dispersed and pulverized in a ball mill so as to have a particle diameter of 1 to 4 μm, so that a reversible thermosensitive recording layer coating liquid was prepared:

| | Parts by Weight |
|---|---|
| Vinyl chloride-vinyl acetate copolymer (Trademark "VYHH", made by Union Carbide Japan K.K.) | 45 |
| Toluene | 200 |
| Methyl ethyl ketone | 200 |
| (Reversible thermosensitive coloring composition) | |
| 3-dibutylamino-7-(o-chlorophenyl)amino-fluoran (Coloring agent) | 10 |
| Octadecylphosphonic acid (Color developer) | 30 |

The thus prepared reversible thermosensitive recording layer coating liquid without the decolorization-accelerating agent, was coated by a wire bar on a polyester film with a thickness of about 100 μm, serving as a support, so that a reversible thermosensitive recording layer with a thickness of about 6 μm was formed on the support. Thus, a comparative reversible thermosensitive coloring recording medium No. 2-1 was prepared.

[Comparative Examples 2-2 to 2-5]

The procedure for preparation of the comparative reversible thermosensitive coloring recording medium No. 2-1 was repeated except that the reversible thermosensitive coloring composition employed in Comparative Example 2-1 was replaced by a reversible thermosensitive coloring composition as shown in Table 5, whereby comparative reversible thermosensitive coloring recording media No. 2-2 to No. 2-5 were prepared.

TABLE 5

| Comp Ex. No. | Coloring Agent | Color Developer | Decolorization-accelerating agent |
|---|---|---|---|
| 2-2 | 3-dibutylamino-7-(o-chlorophenyl) aminofluoran 10 parts | Eicosyl-phosphonic acid 30 parts | — |
| 2-3 | 3-dibutylamino-7-(o-chlorophenyl) aminofluoran 10 parts | Docosyl-phosphonic acid 30 parts | — |
| 2-4 | 3-dibutylamino-6-methyl-7-phenyl-aminofluoran 10 parts | Eicosyl-thiomalic acid 30 parts | — |
| 2-5 | 3-dibutylamino-7-(o-chlorophenyl)-aminofluoran 10 parts | Octadecyl-malonic acid 30 parts | — |

Each of the above prepared reversible thermosensitive coloring recording media No. 2-1 to No. 2-41 according to the present invention and comparative reversible thermosensitive coloring recording media No. 2-1 to No. 2-5 was heated on a hot plate at 125° C. for 30 sec and promptly cooled to 0° C. from the back surface of the recording medium to cause the recording medium to assume a color development state. The color development density of the recording medium in the color development state was measured in the same manner as in Example 1-1 to obtain the initial color development density.

Thereafter, using "Heat Gradient Tester" (Trademark), made by Toyo Seiki Seisaku-sho Ltd., each recording medium was brought into contact with a heating element under application of a pressure of 1 kg/cm$^2$ in such a way that the temperature of the heating element was increased by 2° C. every second. Thus, the decolorization initiation temperature, and the color development initiation temperature of each recording medium were obtained.

In addition, each reversible thermosensitive coloring recording medium in the color development state was heated to a predetermined decolorization treatment temperature shown in Table 6 in the same manner as in Example 1-1 to obtain the decolorized density. The initial color development density, decolorization initiation temperature, color development initiation temperature, and the decolorized density of each recording medium are shown in Table 6.

TABLE 6

| Example No. | Initial Color Development Density | Decolorization Initiation Temperature (°C.) | Color Development Initiation Temperature (°C.) | Decolorization Treatment Temperature (°C.) | Decolorized Density |
|---|---|---|---|---|---|
| Ex. 2-1 | 1.78 | 48 | 86 | 60 | 0.16 |
| Ex. 2-2 | 1.80 | 54 | 86 | 65 | 0.14 |
| Ex. 2-3 | 1.84 | 56 | 90 | 70 | 0.13 |
| Ex. 2-4 | 1.85 | 58 | 94 | 70 | 0.13 |
| Ex. 2-5 | 1.90 | 50 | 90 | 60 | 0.20 |
| Ex. 2-6 | 1.81 | 54 | 86 | 65 | 0.15 |
| Ex. 2-7 | 1.80 | 56 | 90 | 70 | 0.16 |
| Ex. 2-8 | 1.88 | 56 | 88 | 70 | 0.17 |
| Ex. 2-9 | 1.85 | 56 | 88 | 70 | 0.17 |
| Ex. 2-10 | 1.85 | 50 | 90 | 60 | 0.14 |
| Ex. 2-11 | 1.90 | 48 | 88 | 55 | 0.15 |
| Ex. 2-12 | 1.84 | 50 | 90 | 60 | 0.16 |
| Ex. 2-13 | 1.79 | 58 | 92 | 70 | 0.13 |
| Ex. 2-14 | 1.80 | 60 | 94 | 70 | 0.15 |
| Ex. 2-15 | 1.82 | 58 | 94 | 70 | 0.13 |
| Ex. 2-16 | 1.78 | 52 | 86 | 65 | 0.13 |
| Ex. 2-17 | 1.96 | 50 | 90 | 60 | 0.24 |
| Ex. 2-18 | 1.84 | 48 | 90 | 60 | 0.20 |
| Ex. 2-19 | 1.80 | 48 | 92 | 60 | 0.22 |
| Ex. 2-20 | 1.85 | 44 | 90 | 55 | 0.18 |
| Ex. 2-21 | 1.82 | 53 | 86 | 70 | 0.14 |
| Ex. 2-22 | 1.79 | 48 | 86 | 70 | 0.13 |
| Ex. 2-23 | 1.76 | 46 | 86 | 55 | 0.15 |
| Ex. 2-24 | 1.79 | 40 | 88 | 50 | 0.12 |
| Ex. 2-25 | 1.81 | 46 | 90 | 55 | 0.13 |
| Ex. 2-26 | 1.75 | 46 | 90 | 55 | 0.13 |
| Ex. 2-27 | 1.78 | 42 | 86 | 50 | 0.15 |
| Ex. 2-28 | 1.85 | 48 | 90 | 60 | 0.13 |
| Ex. 2-29 | 1.75 | 40 | 88 | 50 | 0.12 |
| Ex. 2-30 | 1.76 | 40 | 88 | 50 | 0.12 |
| Ex. 2-31 | 1.75 | 44 | 90 | 55 | 0.13 |
| Ex. 2-32 | 1.82 | 40 | 84 | 50 | 0.15 |
| Ex. 2-33 | 1.85 | 44 | 88 | 55 | 0.13 |
| Ex. 2-34 | 1.80 | 38 | 86 | 50 | 0.13 |
| Ex. 2-35 | 1.85 | 40 | 92 | 50 | 0.18 |
| Ex. 2-36 | 1.88 | 42 | 90 | 50 | 0.21 |
| Ex. 2-37 | 1.80 | 38 | 92 | 50 | 0.17 |

TABLE 6-continued

| Example No. | Initial Color Development Density | Decolorization Initiation Temperature (°C.) | Color Development Initiation Temperature (°C.) | Decolorization Treatment Temperature (°C.) | Decolorized Density |
|---|---|---|---|---|---|
| Ex. 2-38 | 1.85 | 42 | 94 | 50 | 0.20 |
| Ex. 2-39 | 1.85 | 38 | 90 | 50 | 0.18 |
| Ex. 2-40 | 1.82 | 44 | 86 | 55 | 0.14 |
| Ex. 2-41 | 1.84 | 42 | 90 | 50 | 0.13 |
| Comp. Ex. 5 | 1.85 | 60 | 86 | 70 | 0.19 |
| Comp. Ex. 6 | 1.90 | 64 | 90 | 75 | 0.21 |
| Comp. Ex. 7 | 1.95 | 68 | 90 | 80 | 0.20 |
| Comp. Ex. 8 | 1.96 | 56 | 94 | 65 | 0.30 |
| Comp. Ex. 9 | 1.90 | 60 | 86 | 70 | 0.22 |

As is apparent from the results shown in the above Table 6, the decolorization initiation temperature of the reversible thermosensitive coloring recording medium of the present invention is decreased due to the addition of the decolorization-accelerating agent, and therefore, the temperature range where the recording medium assumes a decolorized state expands in the lower temperature direction in comparison with the case of the comparative reversible thermosensitive coloring recording medium. Moreover, the decolorized density of the recording medium according to the present invention is lower than that of the comparative recording medium. It is confirmed by the above fact that the decolorization was performed more successfully in the recording media No. 2-1 to No. 2-41 according to the present invention than in the comparative recording media No. 2-1 to 2-5.

[EXAMPLE 3-1]

The following components were thoroughly mixed and pulverized:

| | Parts by Weight |
|---|---|
| 3-dibutylamino-7-(o-chlorophenyl)amino-fluoran (Coloring agent) | 2.8 |
| Octadecylphosphonic acid (Color developer) | 8.5 |
| Dodecyl stearate (Decolorization-accelerating agent) | 0.85 |

Thus, a reversible thermosensitive coloring composition (A) according to the preset invention was prepared.

The above prepared reversible thermosensitive coloring composition (A) was the same as that employed in the previously mentioned reversible thermosensitive coloring recording medium No. 2-22 of the present invention, and the decolorization accelerating effect of the coloring composition (A) had already been confirmed.

[EXAMPLES 3-2 to 3-5]

The procedure for preparation of the reversible thermosensitive coloring composition (A) according to the present invention was repeated except that the decolorization-accelerating agent employed in Example 3-1 was replaced by a decolorization-accelerating agent shown in Table 7, whereby reversible thermosensitive coloring compositions (B) to (E) according to the present invention were prepared.

TABLE 7

| Example No. | Decolorization-accelerating Agent | Decolorization Initiation Temperature (°C.) |
|---|---|---|
| Ex. 3-1 | (A) Dodecyl stearate 0.85 parts | 44 |
| Ex. 3-2 | (B) Stearyl stearate 0.85 parts | 55 |
| Ex. 3-3 | (C) Cholesterol stearate 0.85 parts | 62 |
| Ex. 3-4 | (D) Behenic acid 0.85 parts | 56 |
| Ex. 3-5 | (E) n-dioctyl phthalate 0.85 parts | 54 |

The above prepared reversible thermosensitive coloring compositions (B)to (E) were the same as those employed in the previously mentioned reversible thermosensitive coloring recording media No. 2-21, 1-13, 1-2 and 2-24 of the present invention respectively. The decolorization accelerating effect of each coloring composition had been already confirmed.

[Comparative Example 3-1]

The procedure for preparation of the reversible thermosensitive coloring composition (A) of the present invention was repeated except that the decolorization-accelerating agent employed in Example 3-1 was not employed, whereby a comparative reversible thermosensitive coloring composition (A') was prepared.

Using the coloring compositions (A) to (E) according to the present invention and the comparative coloring composition (A'), the decolorization initiation temperature, colored condition and decolorization process were observed in the following manner.

A glass substrate was heated to 170° C. on a hot plate. Then a small amount of each of the coloring compositions (A) to (E) and comparative coloring composition (A') was put on the glass substrate, so that each composition was fused thereon. A cover glass was put on the fused composition to spread it so as to have a uniform thickness, so that the sample of the coloring composition was prepared.

Immediately after removing the sample from the hot plate, the back surface of the glass substrate was brought into contact with ice water to promptly cool the fused coloring composition, and the fused coloring composition eventually set. Thus, the coloring composition assumed the color development state. The changes in optical transmittance of a film of coloring composition in the color development state were measured with the temperature thereof elevated by 4° C./min. The results are shown in FIG. 3.

Figure 3:
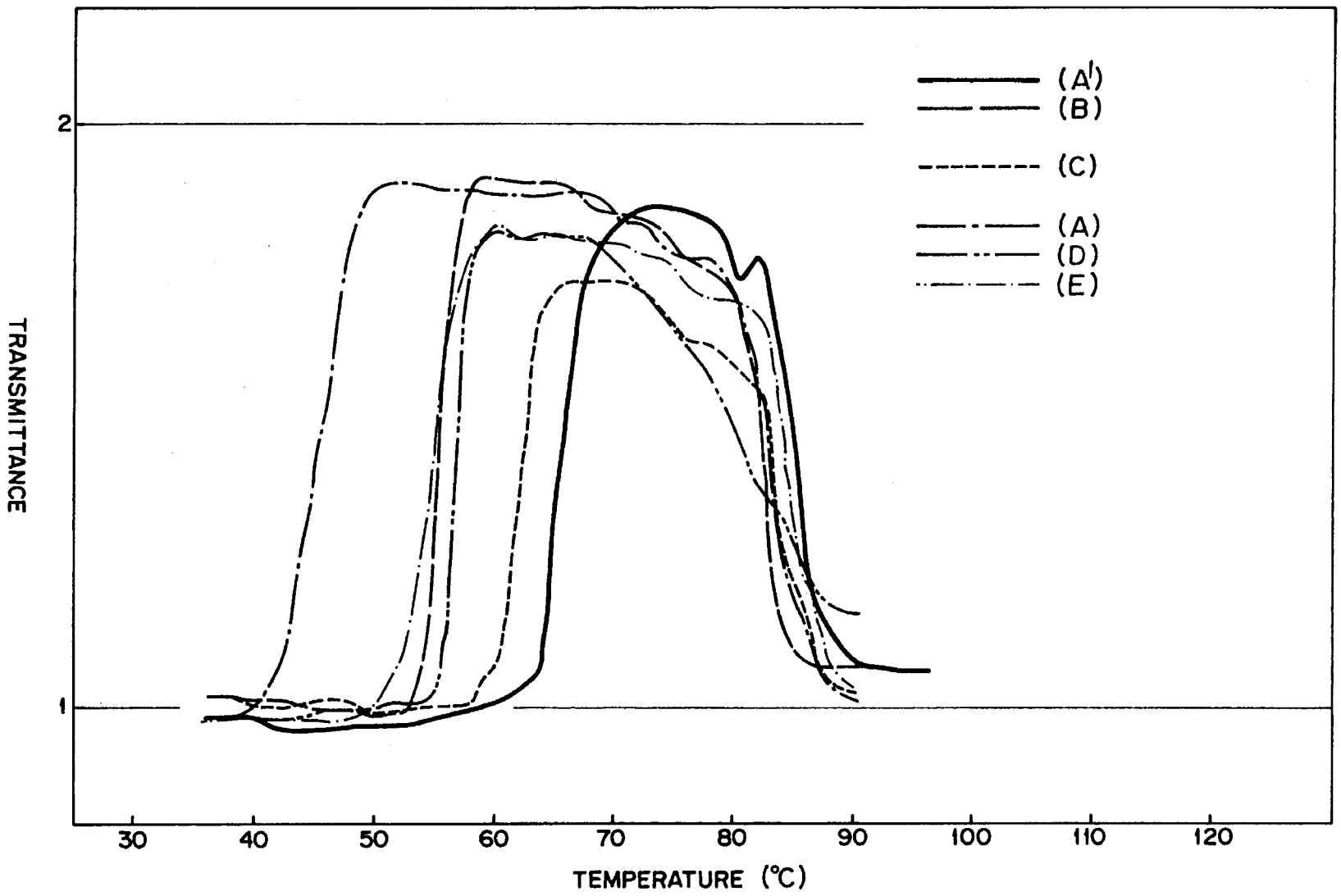
FIG. 3 is a graph showing the relationship between the optical transmittance and the temperature in a reversible thermosensitive coloring compositions of the present invention and a comparative reversible thermosensitive coloring composition.

In FIG. 3, the level of the optical transmittance of the reversible thermosensitive coloring compositions in the initial color development state is supposed to be a level "1". As is apparent from FIG. 3, the decolorization of each coloring composition in the color development state is initiated at a rising point of its individual curve. The decolorization initiation temperature of each coloring composition thus obtained from its individual curve in FIG. 3 is shown in Table 7. The decolorization initiation temperatures of the reversible thermosensitive coloring compositions according to the present invention, which comprise a decolorization-accelerating agent, are lower than that of the comparative coloring composition.

Furthermore, in order to analyze the aggregated structure of the colored material in the color development state, the cover glass was removed from the coloring composition on a glass substrate and the diffraction of X-rays (Cu-Kα) was caused to occur. The results of the diffraction of X-rays are shown in FIG. 4.

Figure 4:
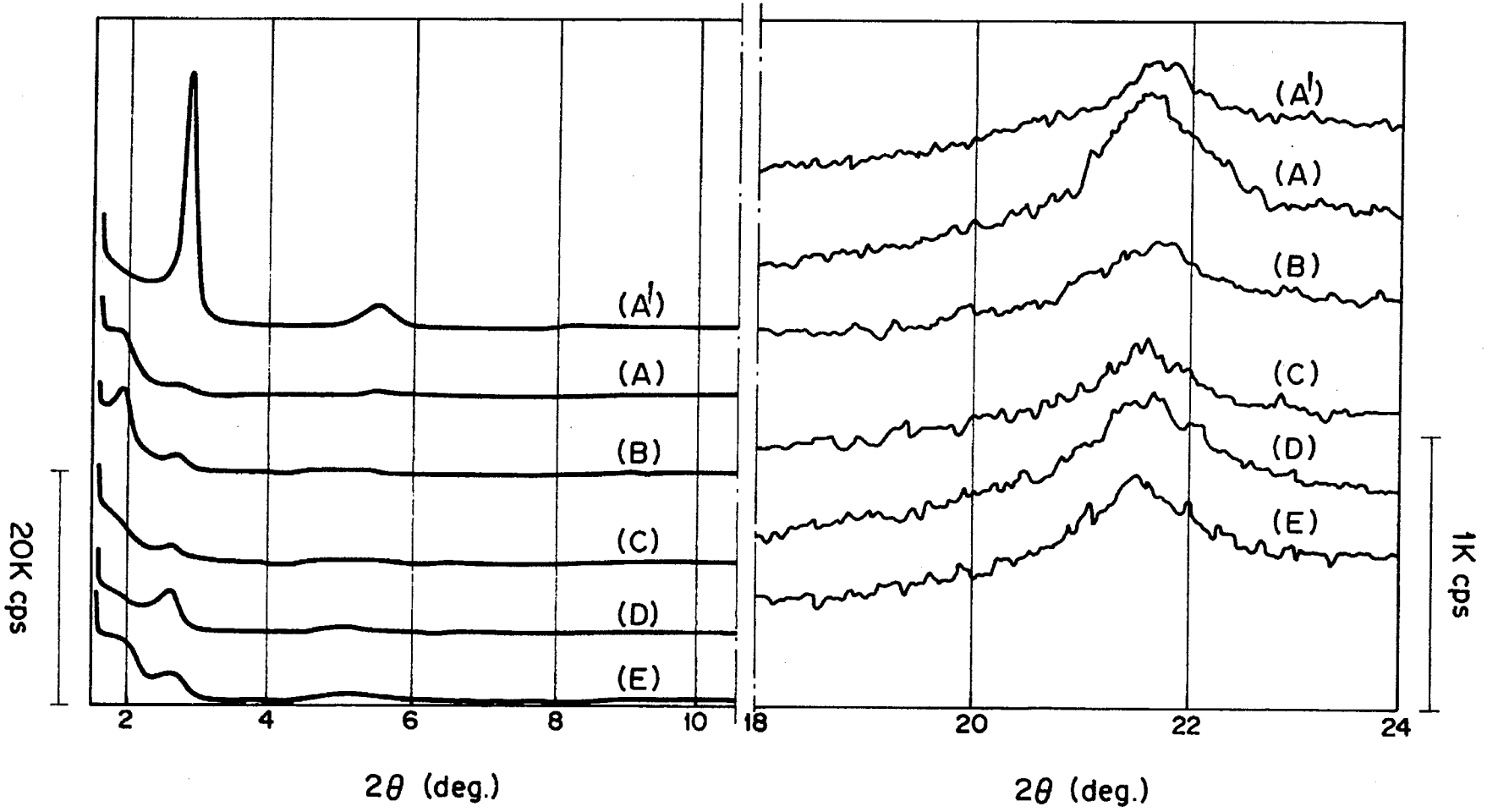
FIG. 4 is a chart of diffraction of X-rays (Cu-Kα) in reversible thermosensitive coloring compositions of the present invention and a comparative reversible thermosensitive coloring composition, for explanation of the regularly aggregated structure in the color development state thereof.

As shown in FIG. 4, in the comparative coloring composition, X-ray diffraction peaks are observed at 2.8° and 21.6° based on the regularly aggregated structure of the colored material.

On the other hand, X-ray diffraction of each of the coloring compositions (A) to (E) according to the present invention shows peaks at 21.6° similarly, but the peak in the lower angle side, which is relatively weak, is indicated at 2.6° as shown in FIG. 4. This suggests the change in the regularly aggregated structure of the colored material in the color development state.

Further, the X-ray diffraction of the coloring composition (B) obtained in Example 3-2 shows a peak at 1.9° due to the crystals of the decolorization-accelerating agent.

The color development state of the reversible thermosensitive coloring compositions (A) to (E) and comparative reversible thermosensitive coloring composition (A') was observed by using an optical microscope. In the coloring compositions (A), (B) and (D), finely-divided crystals were found dispersed in the film of coloring composition in the color development state. It was confirmed that the crystal domains of the decolorization-accelerating agent were independently dispersed in composition.

The decolorization process of each coloring composition was further observed with the temperature thereof elevated by 4° C./min. In the coloring composition (B), crystallites found dispersed in the coloring composition in the initial color development state, disappeared at 51° to 52° C., and crystals of different kind in the form of grain separated out. At this time, the decolorization of the coloring composition (B) was noticed. The decolorization initiation temperature of the coloring composition (B) was 53° C.

Moreover, crystallites found dispersed in the coloring composition (A) in the initial color development state disappeared at 43° C., and at the same time, the decolorization took place. It was found by DSC analysis that stearyl stearate and dodecyl stearate used as the decolorization-accelerating agents in Example 3-2 and Example 3-1 were respectively fused at about 50° C. and 40° C.

Thereafter, the change in X-ray diffraction of each coloring composition in the decolorization process was observed with the temperature thereof raised stepwise.

Figure 5:
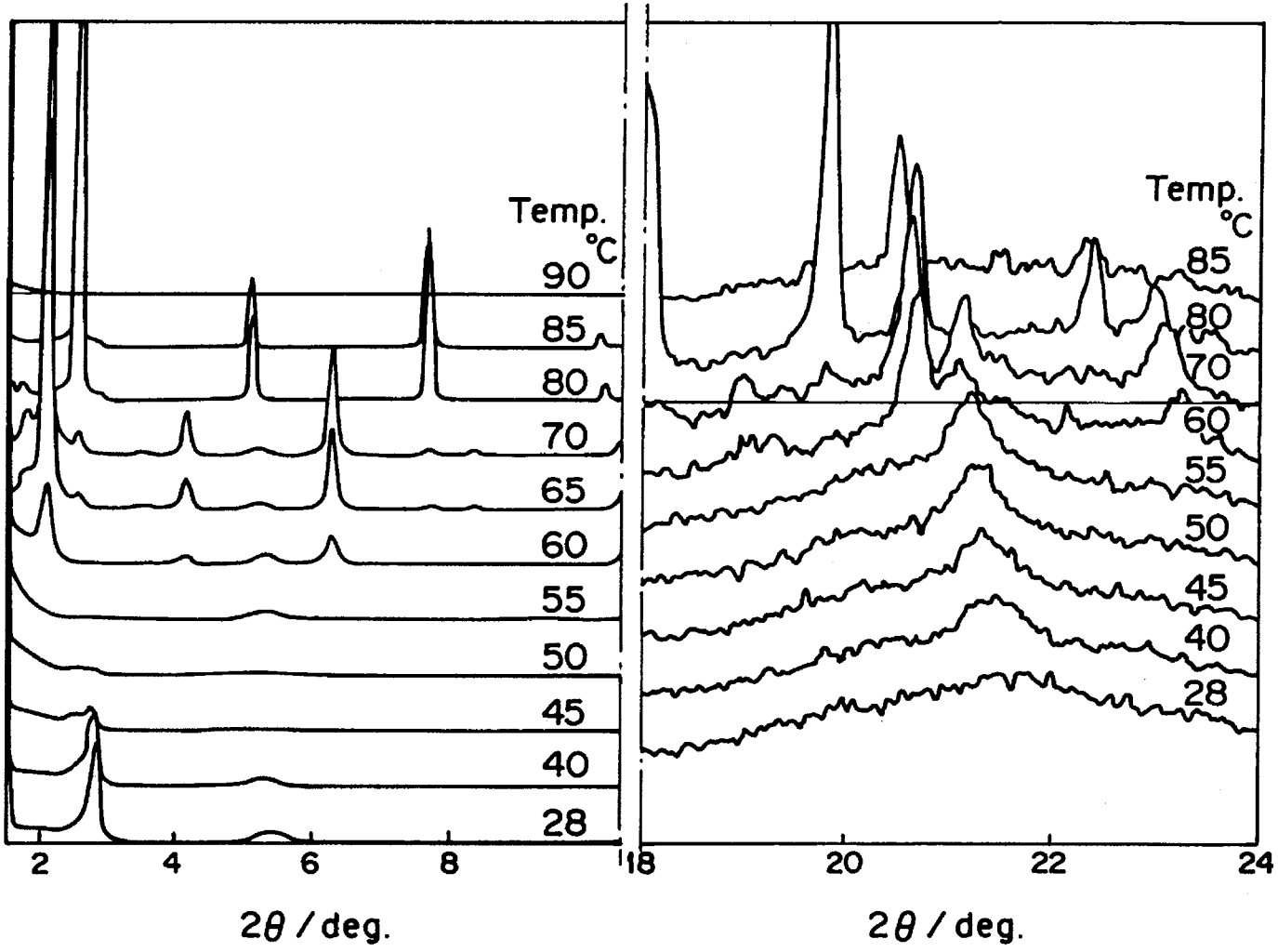
FIG. 5 is a chart showing the change in diffraction of X-rays in a comparative reversible thermosensitive coloring composition without a decolorization-accelerating agent in the decolorization process.

In the comparative coloring composition (A') not comprising the decolorization-accelerating agent, the X-ray diffraction peak showing the regularly aggregated structure of the colored material disappeared at 60°, and then another peak was observed due to the crystals of the octadecylphosphonic acid serving as the color developer separating out of the colored material as shown in FIG. 5. The decolorization of the comparative coloring composition (A') was observed simultaneously with the above-mentioned change in X-ray diffraction.

From the above observation, it was confirmed that the comparative reversible thermosensitive coloring composition can assume the color development state so long as the regularly aggregated structure of the colored material is maintained, and that the decolorization is initiated when the aggregated structure is destroyed and the color developer independently crystallizes by temperature rise.

In the coloring composition according to the present invention, it was confirmed that the regularly aggregated structure of the colored material was destroyed at a lower temperature as compared with the case of the comparative reversible thermosensitive coloring composition, and that the destruction of the regularly aggregated structure of the colored material also corresponded to the decolorization of the coloring comosition. It appears from the observation that the decolorization-accelerating agent in the coloring composition of the present invention can serve to change the regularly aggregated structure of the colored material in the color development state so as to readily induce the decolorization.

Figure 6:
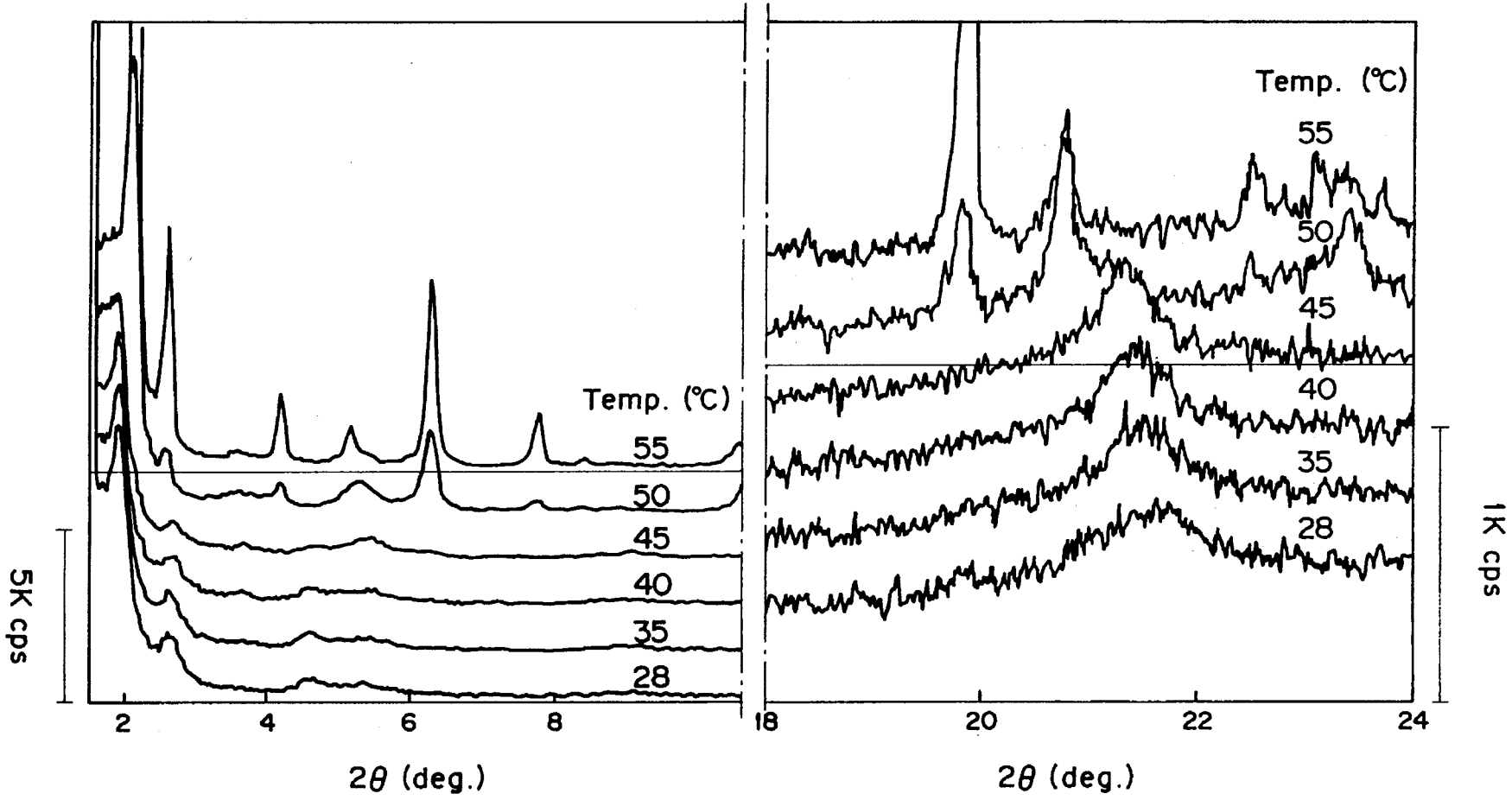
FIGS. 6 and 7 are charts showing the change in diffraction of X-rays in reversible thermosensitive coloring compositions of the present invention in the decolorization process.
Figure 7:
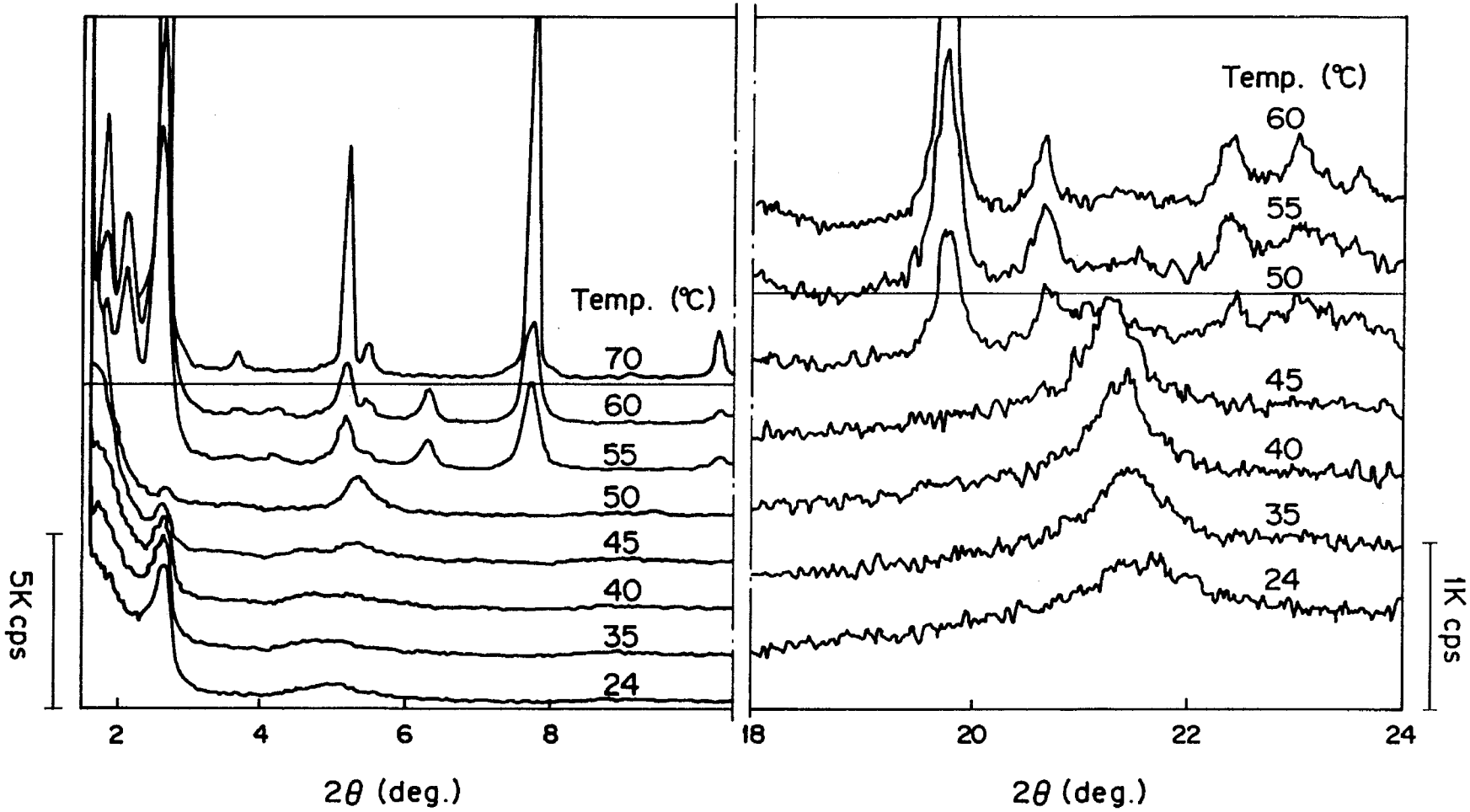

FIG. 6 shows the X-ray diffraction chart of the reversible thermosensitive coloring composition (B), and FIG. 7, that of the reversible thermosensitive coloring composition (D). In the case where stearyl stearate is contained in the coloring composition (B) as a decolorization-accelerating agent, it appears from FIG. 6 that the X-ray diffraction peak is observed at 1.9° due to the crystals of stearyl stearate in the colored material in the color development state, and this peak disappears at an elevated temperature and at the same time, the regularly aggregated structure of the colored material is destroyed and the crystals of the color developer separate out. It was confirmed that the coloring composition (B) was initiated to decolorize at this temperature.

Understandably, therefore, the decolorization-accelerating agent is concerned with the change in regularly aggregated structure of the colored material in the color development state, and promotes the destruction of the regularly aggregated structure thereof. Thus, the decolorization initiation temperature can be decreased. Moreover, when the decolorization-accelerating agent having a low melting point is employed, the decolorization-accelerating agent can readily induce the destruction of regularly aggregated structure of the colored material, thereby accelerating the decolorization of the coloring composition.

[EXAMPLE 4-1]

The following components were thoroughly mixed and pulverized:

| | Parts by Weight |
|---|---|
| 3-dibutylamino-6-methyl-7-phenylaminofluoran (Coloring agent) | 2.7 |
| Eicosylthiomalic acid (Color developer) | 10 |
| Behenic acid | 1 |

-continued

| | Parts by Weight |
|---|---|
| (Decolorization-accelerating agent) | |

Thus a reversible thermosensitive coloring composition (F) according to the present invention was prepared.

The above prepared reversible thermosensitive coloring composition (F) was the same as that employed in the previously mentioned reversible thermosensitive recording medium No. 1-7 of the present invention, and the decolorization accelerating effect of the coloring composition (F) had been already confirmed.

[Comparative Example 4-1]

The procedure for preparation of the reversible thermosensitive coloring composition (F) according to the present invention in Example 4-1 was repeated except that the decolorization-accelerating agent employed in Example 4-1 was not employed, whereby a comparative reversible thermosensitive coloring composition (F') was prepared.

According to the same method as employed in Example 3-1, the samples of the reversible thermosensitive coloring composition (F) of the present invention and the comparative coloring composition (F') which were allowed to assume a color development state were prepared and the optical transmittance was observed to obtain their individual decolorization initiation temperatures. The decolorization initiation temperature of the coloring composition (F) according to the present invention was 53° C., and that of the comparative reversible thermosensitive coloring composition (F') was 52° C.

Figure 8:
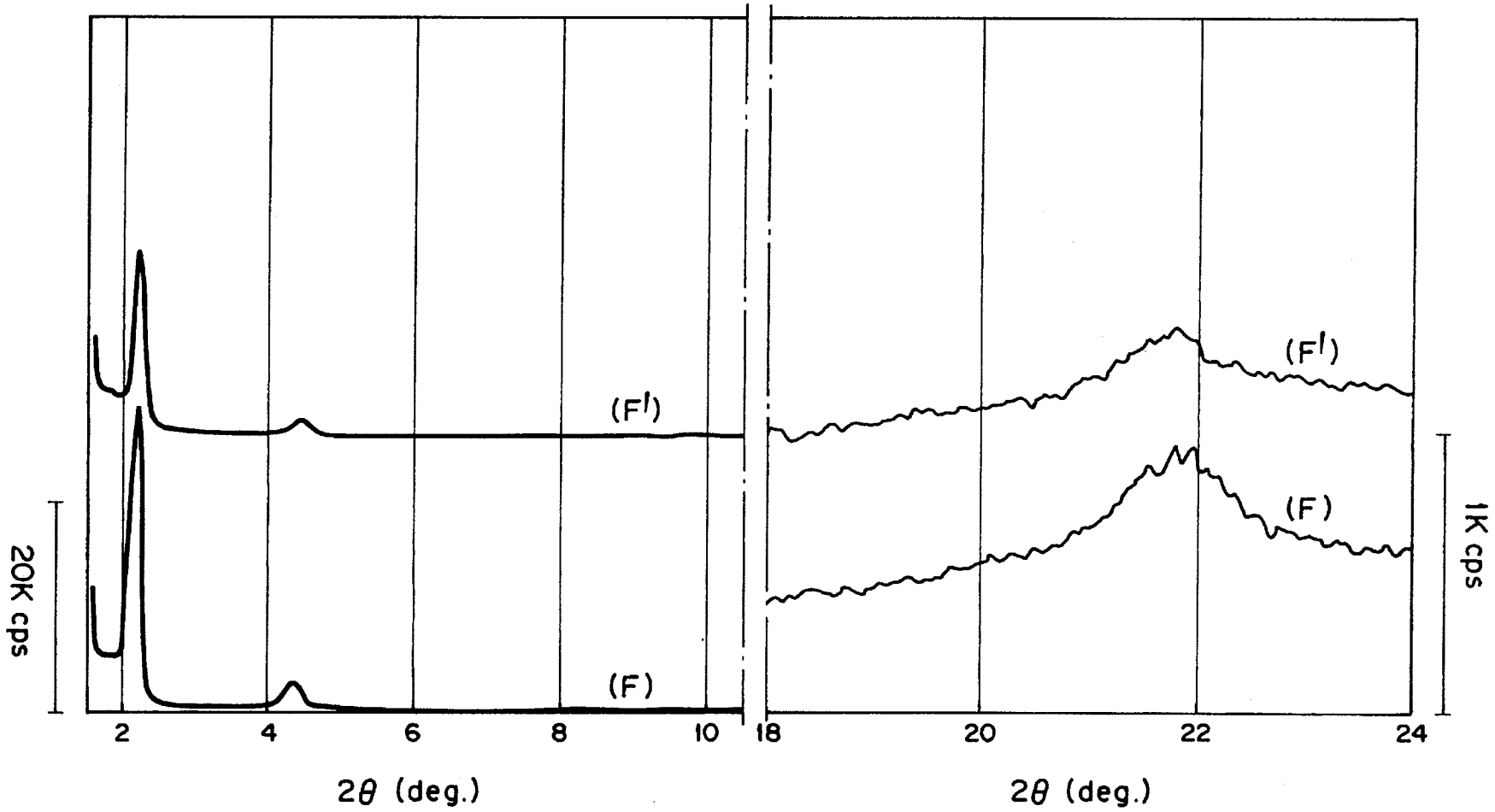
FIG. 8 is a chart of diffraction of X-rays in a reversible thermosensitive coloring composition of the present invention and a comparative coloring composition for explanation of the regularly aggregated structure in the color development state.

To analyze the aggregated structure of each coloring composition in the color development state, the diffraction of X-rays was caused to occur in the same manner as in Example 3-1. The results are shown in FIG. 8. As is apparent from FIG. 8, the diffraction of X-rays in the comparative coloring composition (F') is almost the same as that in the coloring composition (F) according to the present invention, which shows that both of the coloring compositions form aggregated structure with regularity in a color development state.

Figure 9:
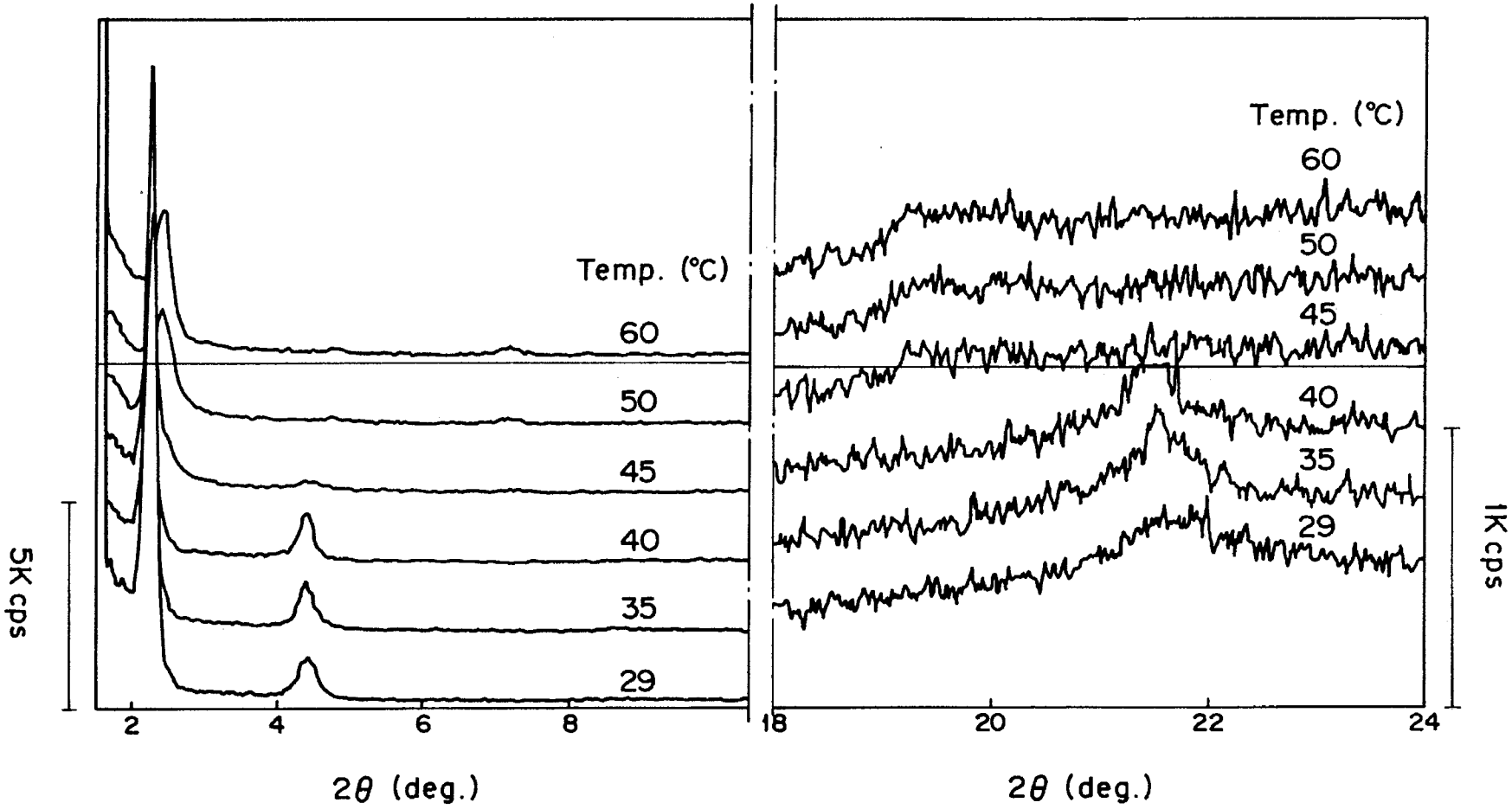
FIG. 9 is a chart showing the change in diffraction of X-rays in a comparative reversible thermosensitive coloring composition without a decolorization-accelerating agent in the decolorization process.
Figure 10:
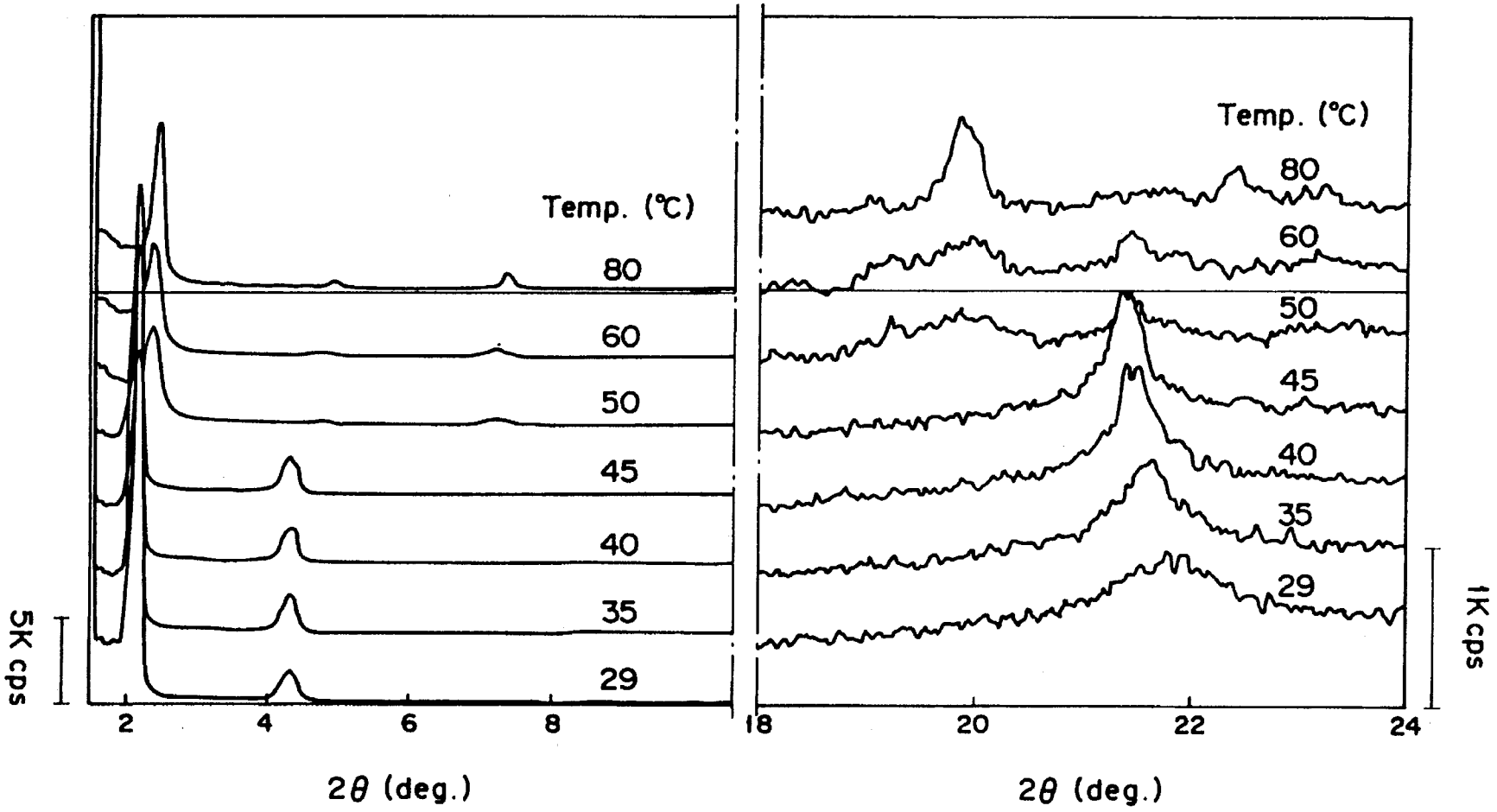
FIG. 10 is a chart showing the change in diffraction of X-rays in a reversible thermosensitive coloring composition according to the present invention in the decolorization process.

Further, the change in X-ray diffraction of each coloring composition in the decolorization process was observed. FIG. 9 shows the X-ray diffraction chart of the comparative reversible thermosensitive coloring composition (F') and FIG. 10 shows the X-ray diffraction chart of the reversible thermosensitive coloring composition (F) according to the present invention.

As shown in FIG. 9, there are observed peaks at 2.2° and 21.6° due to the regularly aggregated structure of the colored material in the comparative coloring composition (F') up to 40° C., and these peaks disappear and a different peak appears at 2.4° in turn due to crystals of the color developer at the temperature of 45° C. It is thought that the regularly aggregated structure of the colored material is destroyed and the color developer crystallizes out of the colored material within the above temperature range of 40° to 45° C., and the decolorization of the coloring composition finally takes place. As is apparent from FIG. 10, the coloring composition (F) according to the present invention causes similar changes within the temperature range of 45° to 50° C. and finally decolorization takes place.

In the case of the coloring composition (F) according to the present invention, the peaks at 2.4° and 19.9° due to the crystals of color developer separating out of the colored material are more prominent than those of the comparative coloring composition (F'). In addition, there is observed a peak at 21.5° due to the crystals of behenic acid used as the decolorization-accelerating agent after decolorization.

The previously mentioned observations prove that the decolorization of the reversible thermosensitive coloring composition according to the present invention which comprises the decolorization-accelerating agent can be more completely achieved in such a way that the decolorization-accelerating agent becomes nuclei of crystallization of the color developer and the crystallization proceeds more speedily as compared with the comparative coloring composition not comprising the decolorization-accelerating agent.

What is claimed is:

1. A reversible thermosensitive coloring composition comprising:

an electron-donor coloring compound, an electron-acceptor compound having a long-chain moiety in the molecule which controls the cohesion between the molecules thereof, said electron-acceptor compound (a) capable of producing a colored material with a regularly aggregated structure in said electron-donor coloring compound with the application of heat thereto to a color development initiation temperature which is above the melting point of the mixture of said electron-donor coloring compound and said electron-acceptor compound to obtain a color development state, and (b) capable of crystallizing out of said colored material when said regularly aggregated structure of said colored material is destroyed with the application of heat thereto to a decolorization initiation temperature which is below said color development initiation temperature to obtain a decolorization state, thereby reversibly providing said color development state and said decolorization state, and an organic compound serving as a decolorization-accelerating agent dispersed in said coloring composition in the form of molecules or minute domains, capable of inducing the destruction of said regularly aggregated structure of said colored material and accelerating the decolorization of said colored material in a decolorization process.

2. A reversible thermosensitive coloring composition comprising:

an electron-donor coloring compound, an electron-acceptor compound having a long-chain moiety in the molecule which controls the cohesion between the molecules thereof, said electron-acceptor compound (a) capable of producing a colored material with a regularly aggregated structure in said electron-donor coloring compound with the application of heat thereto to a color development initiation temperature which is above the melting point of the mixture of said electron-donor coloring compound and said electron-acceptor compound to obtain a color development state, and (b) capable of crystallizing out of said colored material when said regularly aggregated structure of said colored material is destroyed with the application of heat thereto to a decolorization initiation temperature which is below said color development initiation temperature to obtain a decolorization state, thereby reversibly providing said color development state and said decolorization state, and an organic compound serving as a decolorization-accelerating agent dispersed in said coloring composition in the form of minute domains, which is capable of melting first to induce the destruction of said regularly aggregated structure of said colored material in a decolorization process.

3. A reversible thermosensitive coloring composition comprising:

an electron-donor coloring compound, an electron-acceptor compound having a long-chain moiety in the molecule which controls the cohesion between the molecules thereof, said electron-acceptor compound (a) capable of producing a colored material with a regularly aggregated structure in said electron-donor coloring compound with the application of heat thereto to a color development initiation temperature which is above the melting point of the mixture of said electron-donor coloring compound and said electron-acceptor compound to obtain a color development state, and (b) capable of crystallizing out of said colored material when said regularly aggregated structure of said colored material is destroyed with the application of heat thereto to a decolorization initiation temperature which is below said color development initiation temperature to obtain a decolorization state, thereby reversibly providing said color development state and said decolorization state, and an organic compound serving as a decolorization-accelerating agent dispersed in said coloring composition in the form of minute domains, which is capable of serving as nuclei for the crystallization of said electron-acceptor compound when said regularly aggregated structure of said colored material is destroyed and said electron-acceptor compound crystallizes out of said colored material in a decolorization process.

4. A reversible thermosensitive coloring recording medium comprising a support and a reversible thermosensitive recording layer formed thereon, comprising a reversible thermosensitive coloring composition which comprises:

an electron-donor coloring compound, an electron-acceptor compound having a long-chain moiety in the molecule which controls the cohesion between the molecules thereof, said electron-acceptor compound (a) capable of producing a colored material with a regularly aggregated structure in said electron-donor coloring compound with the application of heat thereto to a color development initiation temperature which is above the melting point of the mixture of said electron-donor coloring compound and said electron-acceptor compound to obtain a color development state, and (b) capable of crystallizing out of said colored material when said regularly aggregated structure of said colored material is destroyed with the application of heat thereto to a decolorization initiation temperature which is below said color development initiation temperature to obtain a decolorization state, thereby reversibly providing said color development state and said decolorization state, and an organic compound serving as a decolorization-accelerating agent dispersed in said coloring composition in the form of molecules or minute domains, capable of inducing the destruction of said regularly aggregated structure of said colored material and accelerating the decolorization of said colored material in a decolorization process.

5. A reversible thermosensitive coloring recording medium comprising a support and a reversible thermosensitive recording layer formed thereon, comprising a reversible thermosensitive coloring composition comprising:

an electron-donor coloring compound, an electron-acceptor compound having a long-chain moiety in the molecule which controls the cohesion between the molecules thereof, said electron-acceptor compound (a) capable of producing a colored material with a regularly aggregated structure in said electron-donor coloring compound with the application of heat thereto to a color development initiation temperature which is above the melting point of the mixture of said electron-donor coloring compound and said electron-acceptor compound to obtain a color development state, and (b) capable of crystallizing out of said colored material when said regularly aggregated structure of said colored material is destroyed with the application of heat thereto to a decolorization initiation temperature which is below said color development initiation temperature to obtain a decolorization state, thereby reversibly providing said color development state and said decolorization state, and an organic compound serving as a decolorization-accelerating agent dispersed in said coloring composition in the form of minute domains, which is capable of melting first to induce the destruction of said regularly aggregated structure of said colored material in a decolorization process.

6. A reversible thermosensitive coloring recording medium comprising a support and a reversible thermosensitive recording layer formed thereon, comprising a reversible thermosensitive coloring composition comprising:

an electron-donor coloring compound, an electron-acceptor compound having a long-chain moiety in the molecule which controls the cohesion between the molecules thereof, said electron-acceptor compound (a) capable of producing a colored material with a regularly aggregated structure in said electron-donor coloring compound with the application of heat thereto to a color development initiation temperature which is above the melting point of the mixture of said electron-donor coloring compound and said electron-acceptor compound to obtain a color development state, and (b) capable of crystallizing out of said colored material when said regularly aggregated structure of said colored material is destroyed with the application of heat thereto to a decolorization initiation temperature which is below said color development initiation temperature to obtain a decolorization state, thereby reversibly providing said color development state and said decolorization state, and an organic compound serving as a decolorization-accelerating agent dispersed in said coloring composition in the form of minute domains, which is capable of serving as nuclei for the crystallization of said electron-acceptor compound when said regularly aggregated structure of said colored material is destroyed and said electron-acceptor compound crystallizes out of said colored material in a decolorization process.

* * * * *

UNITED STATES PATENT AND TRADEMARK OFFICE

CERTIFICATE OF CORRECTION

PATENT NO. : 5,521,138
DATED: : May 28, 1996
INVENTOR(S) : Masaru SHIMADA et al

It is certified that error appears in the above-identified patent and that said Letters patent is hereby corrected as shown below:

On the title page, at item [75] last line, after "Mishima," add - - Hiroki KUBOYAMA, Mishima-shi; Ichiro SAWAMURA, Numazu-shi; Takehito YAMAGUCHI, Shizuoka-ken,- -.

Column 3, line 53, after "the" insert --above-mentioned reversible thermosensitive coloring composition.--.

Column 6, line 36, "state-at" should read --state at--.

Column 13, line 52, "cabon" should read --carbon--.

Column 17, line 27, "example" should read --examples--.

UNITED STATES PATENT AND TRADEMARK OFFICE

CERTIFICATE OF CORRECTION

PATENT NO. : 5,521,138
DATED: : May 28, 1996
INVENTOR(S) : Masaru SHIMADA et al

It is certified that error appears in the above-identified patent and that said Letters patent is hereby corrected as shown below:

Column 20, line 67, "recoding" should read --recording--.

Column 23, line 25, "6 82 m" should read --6μm--.

Column 31, line 49, "preset" shoud read --present--.

Column 34, line 23, "comosition." should read --composition.--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*